US008145100B2

(12) United States Patent
Hirayama et al.

(10) Patent No.: US 8,145,100 B2
(45) Date of Patent: Mar. 27, 2012

(54) PROCESS CARTRIDGE INCLUDING DEVELOPING UNIT AND INCORPORATED IN IMAGE FORMING APPARATUS

(75) Inventors: Yushi Hirayama, Sagamihara (JP); Shinji Kato, Kawasaki (JP); Takeroh Kurenuma, Ebina (JP); Keiichi Yoshida, Kawasaki (JP); Shin Hasegawa, Zama (JP); Hitoshi Ishibashi, Kamakura (JP); Yoshiaki Miyashita, Komae (JP); Kohta Fujimori, Yokohama (JP); Nobutaka Takeuchi, Yokohama (JP); Tetsuya Muto, Kawasaki (JP); Akira Yoshida, Kawasaki (JP); Hiroyuki Uenishi, Sagamihara (JP)

(73) Assignee: Ricoh Company, Ltd., Tokyo (JP)

( * ) Notice: Subject to any disclaimer, the term of this patent is extended or adjusted under 35 U.S.C. 154(b) by 580 days.

(21) Appl. No.: 12/360,321

(22) Filed: Jan. 27, 2009

(65) Prior Publication Data

US 2009/0190960 A1 Jul. 30, 2009

(30) Foreign Application Priority Data

Jan. 28, 2008 (JP) ..... 2008-016721
Mar. 17, 2008 (JP) ..... 2008-068149

(51) Int. Cl.
*G03G 15/08* (2006.01)

(52) U.S. Cl. ..... 399/256

(58) Field of Classification Search ..... 399/64, 399/61, 74, 30, 256
See application file for complete search history.

(56) References Cited

U.S. PATENT DOCUMENTS

| | | | | |
|---|---|---|---|---|
| 4,956,669 | A * | 9/1990 | Nakamura | |
| 4,963,929 | A * | 10/1990 | Ueda et al. | |
| 5,036,358 | A * | 7/1991 | Yoshida | 399/64 |
| 7,463,852 | B2 | 12/2008 | Yoshida et al. | |
| 2008/0069580 | A1 | 3/2008 | Oshige et al. | |
| 2008/0145078 | A1 | 6/2008 | Tomita et al. | |

FOREIGN PATENT DOCUMENTS

| | | | |
|---|---|---|---|
| JP | 5-150650 | | 6/1993 |
| JP | 2003-307918 | | 10/2003 |
| JP | 2004-139038 | | 5/2004 |
| JP | 2006-154001 | | 6/2006 |
| JP | 2006154001 | A * | 6/2006 |
| JP | 2007286131 | A * | 11/2007 |

* cited by examiner

*Primary Examiner* — Susan Lee
(74) *Attorney, Agent, or Firm* — Oblon, Spivak, McClelland, Maier & Neustadt, L.L.P.

(57) ABSTRACT

A process cartridge for use in an image forming apparatus includes an image bearing member and a developing unit. The developing unit includes a developer bearing member to bear developer including toner and carrier, a casing forming a developer container containing the developer, a screw having a shaft with a spiral screw blade, a toner density sensor to detect a density of the toner on a detection surface, and a detection surface agitating member fixedly mounted on the shaft of the screw at a position facing a detection surface to scrape away the developer accumulated on the detection surface as the screw rotates. The detection surface agitating member includes an elastic sheet elastically deformable to scrape away the developer accumulated on the detection surface and disposed at a substantially same angle to an axial direction of the shaft of the screw as the spiral screw blade.

13 Claims, 14 Drawing Sheets

COMPARATIVE EXAMPLE : LINEAR VELOCITY 230 [mm/s]

COMPARATIVE EXAMPLE : LINEAR VELOCITY 77 [mm/s]

PROCESS CARTRIDGE INCLUDING DEVELOPING UNIT AND INCORPORATED IN IMAGE FORMING APPARATUS

CROSS-REFERENCE TO RELATED APPLICATIONS

The present invention claims priority pursuant to 35 U.S.C. §119 from Japanese Patent Application No. 2008-016721, filed on Jan. 28, 2008 in the Japan Patent Office, and Japanese Patent Application No. 2008-068149, filed on Mar. 17, 2008 in the Japan Patent Office, the contents and disclosures of each of which are hereby incorporated by reference herein in their entirety.

BACKGROUND OF THE INVENTION

1. Field of the Invention

Exemplary embodiments of the present invention generally relate to a process cartridge that includes a developing unit and is incorporated in an image forming apparatus such as a copier, printer, facsimile machine, and the like.

2. Discussion of the Related Art

Developing units that develop toner images for electrophotographic printing generally employ either a one-component developer or a two-component developer. While the one-component developer includes toner particles only, the two-component developer includes toner particles and magnetic carrier particles. The two-component developer is widely used in a developing unit where the two-component developer is mixed in a developer container so as to frictionally charge the two-component developer (hereinafter "developer") and cause a developer bearing member to hold the charged developer thereon. Toner particles or toner in the developer carried by the developer bearing member selectively adhere to an electrostatic latent image so that a visible toner image can be formed or developed thereat.

When development is performed, toner is consumed and the consumption of toner decreases toner density in the developer, which can prevent production of high-density images. By contrast, developer having a high toner density can cause background contamination on an image. In other words, to obtain a high quality image, the toner density in the developer contained in the developer container must be controlled so as to remain within a given optimum range.

Some developer units include a toner supply unit to supply toner to the developer container. Such a developing unit includes a toner density detection unit and a toner supply amount controller. The toner density detection unit (hereinafter referred to as a toner density sensor) is a detector or sensor to detect or sense the toner density in the developer container. The toner supply amount controller controls an amount of toner for supplying the developer container. With these units, the supply of toner into the developer container is controlled.

As a toner density sensor, a magnetic sensor is known. The magnetic sensor detects a designated area or a portion of an inner wall of a developer container set as a detection surface to detect changes of magnetic permeability in the developer in the vicinity of the detection surface. The accuracy of this toner density sensor, however, can be degraded by developer accumulating on the detection surface, which can cause the toner supply amount controller to malfunction.

To eliminate the above-described drawbacks, a technique has been proposed in which a planar member is fixedly disposed parallel to a shaft member inside the developer container at a position facing that part of the shaft member of a conveyance screw that conveys developers while agitating the developer inside the developer container which serves as the detection surface, and an elastic sheet is fixedly attached parallel to the planar member. The planar member and the elastic sheet rotate with the conveyance screw, and the elastic sheet scrapes away the developer accumulated on the detection surface of the shaft member of the conveyance screw. By so doing, the developer on the detection surface is agitated and the detection error caused by the accumulation of developer on the detection surface of the toner density sensor can be prevented. It is to be noted that bending rigidity of the planar member is significantly greater than that of the elastic sheet, and therefore deformation of the planar member by removing and agitating the developer repeatedly can be ignored.

However, it can be shown experimentally that, when using the above-described technique with its configuration in which the elastic sheet scrape away developer accumulated on the detection surface, the detected values of the toner density sensor fluctuated in synchronization with a rotation cycle of the elastic sheet as it is scraping away developer accumulated on the detection surface while agitating the developer. This is because the developer density on the detection surface varies before and after the elastic sheet scrapes away the developer on the detection surface. Specifically, before the elastic sheet scrapes away the developer on the detection surface, the elastic sheet pushes the developer onto the detection surface, which increases the developer density on the detection surface. When the elastic sheet cleans the detection surface, the elastic sheet flips up the developer in the vicinity of the detection surface. Therefore, after the elastic sheet scrapes away the developer on the detection surface, there may be a void or space in the vicinity of the detection surface, resulting in a decrease in the developer density on the detection surface.

When the difference in developer densities on the detection surface before and after scraping the detection surface during the agitating operation is large, the detection accuracy of the toner density sensor decreases. Therefore, it is desired to reduce the difference in developer densities on the detection surface. In addition, the difference in developer densities on the detection surface during the agitating operation varies depending on such things as the number of rotations of the conveyance screw, the environment in which the equipment operates, aging of developer, etc. When the fluctuation in developer densities on the detection surface during the agitating operation is large, the toner density detection accuracy also fluctuates depending on use conditions. Therefore, it is desired to reduce differences in developer densities on the detection surface.

SUMMARY OF THE INVENTION

Exemplary aspects of the present invention have been made in view of the above-described circumstances.

Exemplary aspects of the present invention provide a process cartridge that can effectively prevent detection error caused by accumulation of developer on a detection surface of a toner detection sensor and reduce a difference in developer densities on the detection surface during agitation.

In one exemplary embodiment, a process cartridge for use in an image forming apparatus includes an image bearing member to bear an image on a surface thereof and a developing unit to develop the image formed on the image bearing member and integrally incorporated together with the image bearing member in the process cartridge. The developing unit includes a developer bearing member used for image developing and to bear developer including toner particles and carrier particles, a casing to form a developer container containing the developer to supply to the developer bearing member, a screw having a shaft with a spiral screw blade fixedly mounted thereon and which rotates around the shaft to agitate the developer in the casing and convey the developer in an axial direction of the shaft, a toner density sensor to detect a density of the toner particles on a detection surface formed by a part of an inner wall of the casing disposed parallel to the shaft of the conveyance screw, and a detection surface agitating member fixedly mounted on the shaft of the screw at a position facing the detection surface to scrape away the developer accumulated on the detection surface as the screw rotates. The detection surface agitating member includes an elastic sheet disposed at a substantially same angle to the axial direction of the shaft of the screw as the spiral screw blade and is elastically deformable to scrape away the developer accumulated on the detection surface.

The above-described process cartridge may further include a planar member fixedly mounted on the shaft of the screw in the developing unit at a position facing the detection surface and that rotates without contacting the inner wall of the casing as the screw rotates, and has a rigidity sufficient substantially to prevent the planar member from deforming during agitation of the developer. The planar member may be arranged at a substantially same angle to the axial direction of the shaft of the screw as the spiral screw blade and having the elastic sheet fixed thereon.

The elastic sheet may be fixed to the screw blade facing the detection surface for the screw.

The above-described process cartridge may further include a developer conveyance path surrounded by the inner wall of the casing and along which the screw applies a conveyance force to convey the developer. The developer conveyance path may have a cross-section narrower in the vicinity of the detection surface than a position upstream from the detection surface in a direction of conveyance of developer by the screw.

A pitch of adjacent portions of the spiral screw blade on the screw may be narrower at a position in the vicinity of the detection surface than a position upstream from the position in the vicinity of the detection surface in the direction of conveyance of developer by the screw.

Further, in one exemplary embodiment, a process cartridge for use in an image forming apparatus includes an image bearing member to bear an image on a surface thereof and a developing unit to develop the image formed on the image bearing member and integrally incorporated together with the image bearing member in the process cartridge. The developing unit includes a developer bearing member used for image developing and to bear developer including toner particles and carrier particles, a casing to form a developer container containing the developer to supply to the developer bearing member, a screw having a shaft with a spiral screw blade fixedly mounted thereon and which rotates around the shaft to agitate the developer in the casing and convey the developer in an axial direction of the shaft, a toner density sensor to detect a density of the toner particles on a detection surface formed by a part of an inner wall of the casing disposed parallel to the shaft of the conveyance screw, and a detection surface agitating member fixedly mounted on the shaft of the screw at a position facing the detection surface to scrape away the developer accumulated on the detection surface as the screw rotates. The detection surface agitating member includes multiple elastic sheets elastically deformable to scrape away the developer accumulated on different areas of the detection surface in an axial direction of the shaft. The multiple elastic sheets are disposed adjacent to each other in the axial direction of the shaft, arranged at different positions along a direction of rotation of the screw.

The detection surface may be included in an area in which at least one of the multiple elastic sheets scrapes away the developer.

Of the multiple elastic sheets, an elastic sheet disposed further downstream in a direction of conveyance of the developer along the axis of the shaft may be arranged further upstream in the direction of rotation of the screw.

At least one of the multiple elastic sheets may be arranged at a substantially same angle to the axial direction of the shaft of the screw as the spiral screw blades to the shaft.

The above-described process cartridge may further include a planar member fixedly mounted on the shaft of the screw in the developing unit at a position facing the detection surface which rotates without contacting the inner wall during a rotation of the screw, and has a rigidity sufficient substantially to prevent the planar member from deforming during agitation of the developer. The planar member may be arranged at a substantially same angle to the axial direction of the shaft of the screw as the spiral screw blades and having the elastic sheet fixed thereon.

The above-described process cartridge may further include a developer conveyance path surrounded by the inner wall of the casing and along which the screw applies a conveyance force to convey the developer. The developer conveyance path may have a cross-section narrower in the vicinity of the detection surface than a position upstream from the detection surface in a direction of conveyance of developer by the screw.

A pitch of adjacent portions of the spiral screw blade on the screw may be narrower in the vicinity of the detection surface than a position upstream from the detection surface in the direction of conveyance of developer by the screw.

Further, in one exemplary embodiment, a process cartridge for use in an image forming apparatus includes an image bearing member to bear an image on a surface thereof and a developing unit to develop the image formed on the image bearing member and integrally incorporated together with the image bearing member in the process cartridge. The developing unit includes a developer bearing member used for image developing and to bear developer including toner particles and carrier particles, a casing to form a developer container containing the developer to supply to the developer bearing member, a screw having a shaft with a spiral screw blade fixedly mounted thereon and which rotates around the shaft to agitate the developer in the casing and convey the developer in an axial direction of the shaft, a toner density sensor to detect a density of the toner particles on a detection surface formed by a part of an inner wall of the casing disposed parallel to the shaft of the conveyance screw, and a detection surface agitating member fixedly mounted on the shaft of the screw at a position facing the detection surface to scrape away the developer accumulated on the detection surface as the screw rotates. The detection surface agitating member includes a planar member fixedly mounted on the shaft of the screw in the developing unit at a position facing the detection surface and which rotates without contacting the inner wall of the casing as the screw rotates, and has a rigidity sufficient substantially to prevent the planar member from deforming during agitation of the developer.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein:

FIG. 13A is a graph showing TC-Vt characteristics and FIG. 13B is a graph showing characteristics of linear velocity shift volume ΔVt;

FIG. 14A is a graph showing TC-Vt characteristics and FIG. 14B is a graph showing characteristics of linear velocity shift volume ΔVt;

FIG. 15A is a graph showing TC-Vt characteristics and FIG. 15B is a graph showing characteristics of linear velocity shift volume ΔVt;

DETAILED DESCRIPTION OF THE PREFERRED EMBODIMENTS

Figure 1:
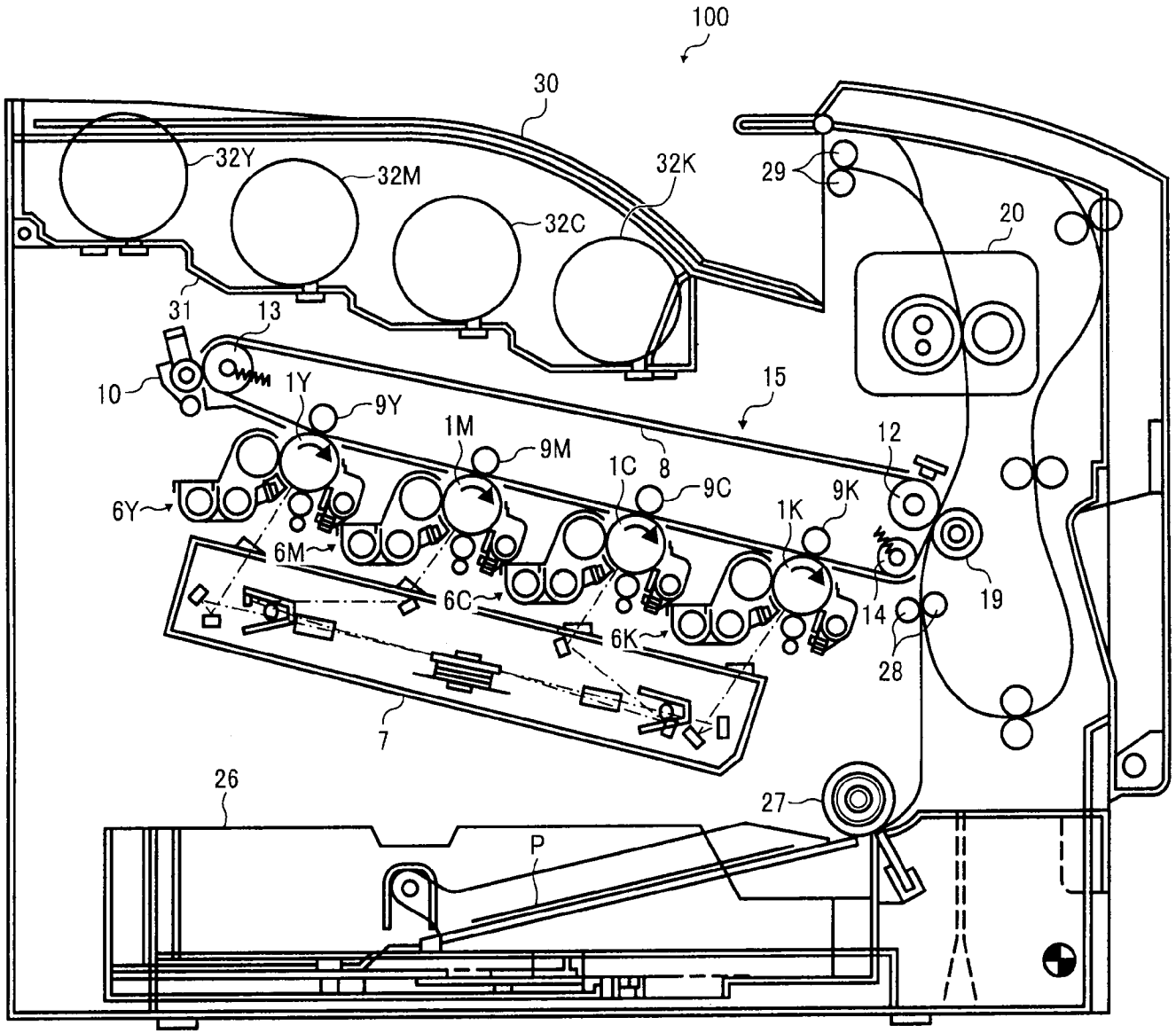
FIG. 1 is a view illustrating a schematic configuration of an electrophotographic printer according to an exemplary embodiment of the present invention.

In describing preferred embodiments illustrated in the drawings, specific terminology is employed for the sake of clarity. However, the disclosure of the present invention is not intended to be limited to the specific terminology so selected and it is to be understood that each specific element includes all technical equivalents that operate in a similar manner.

Referring now to the drawings, wherein like reference numerals designate identical or corresponding parts throughout the several views, preferred embodiments of the present invention are described.

Referring to FIG. 1, a schematic configuration of an electrophotographic printer is described as an exemplary embodiment of the present invention. Hereinafter, the electrophotographic printer is referred to as a printer 100.

The printer 100 shown in FIG. 1 includes four process cartridges 6Y, 6C, 6M, and 6K, four toner bottles 32Y, 32C, 32M and 32K of a toner bottle container 31 as a toner feeding mechanism, an optical writing unit 7, a transfer unit 15 as a transfer mechanism, a sheet feeding cassette 26 as a sheet feeding mechanism, and a fixing unit 20 as a fixing mechanism.

The process cartridges 6Y, 6C, 6M, and 6K serve as image forming mechanisms of the printer 100 and include respective consumable image forming components to perform image forming operations for producing respective toner images with toners of different colors of yellow (Y), cyan (C), magenta (M), and black (K). The process cartridges 6Y, 6C, 6M, and 6K are separately disposed at positions having different heights in a stepped manner and are detachably provided for use in the printer 100 so that each of the process cartridges 6Y, 6C, 6M, and 6K can be replaced at once at an end of its useful life. Since the four process cartridges 6Y, 6C, 6M, and 6K have similar structures and functions, except that respective toners are of different colors, which are yellow, cyan, magenta and black toners, the discussion below will be focused on the process cartridge 6Y and the image forming components incorporated therein.

Figure 2:
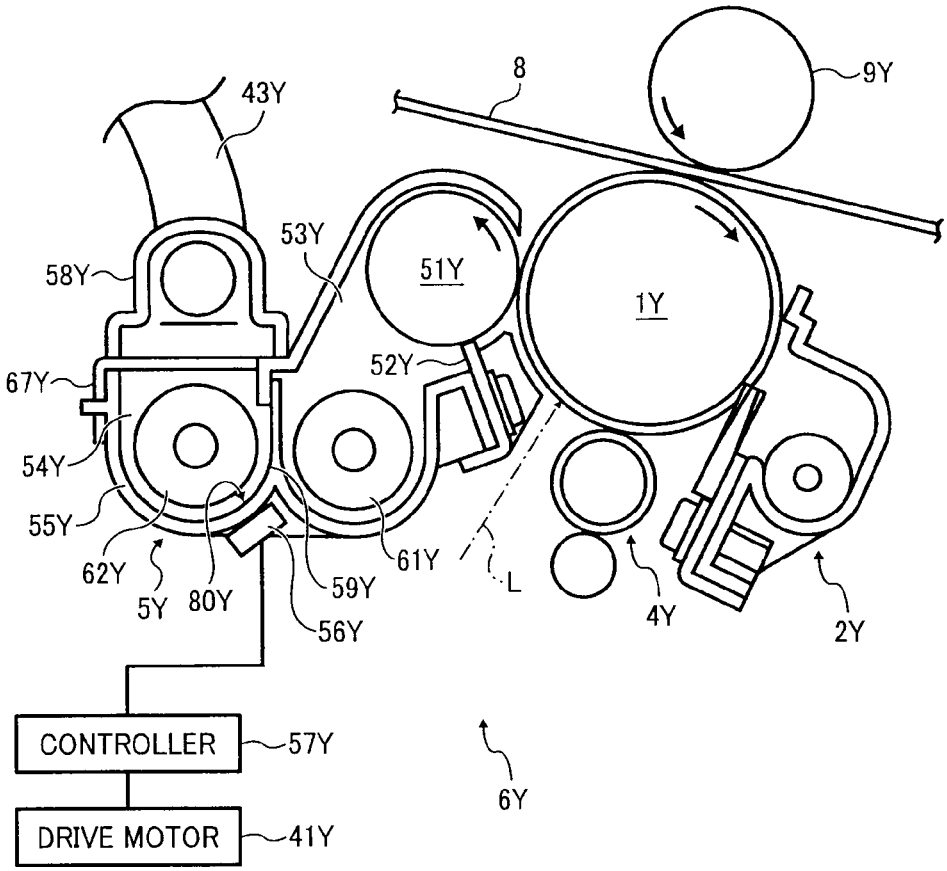
FIG. 2 is an enlarged view illustrating a schematic configuration of a process cartridge included in the printer of FIG. 1 for producing yellow toner image and image forming components around the process cartridge.

FIG. 2 shows a schematic configuration of the process cartridge 6Y for producing yellow toner images.

The process cartridge 6Y has image forming components around it. The image forming components included in the process cartridge 6Y are a photoconductor 1Y, a drum cleaning unit 2Y, a discharging unit (not shown), a charging unit 4Y, a developing unit 5Y, and so forth. The process cartridge 6Y is detachably attachable to a main body of the printer 100, thereby replacing the image forming components incorporated therein or consumables at one time.

The photoconductor 1Y is a rotating member including a cylindrical conductive body having a relatively thin base. In this embodiment, a drum type image carrier such as the photoconductor 1Y is used. However, as an alternative, a belt type image bearing member may be applied as well.

The charging unit 4Y including a charging roller (not shown) is applied with a charged voltage. When the photoconductor 1Y is driven by a rotation drive unit (not shown) as a rotation drive mechanism, and is rotated in a clockwise direction as indicated by an arrow shown in FIG. 2, the charging unit 4Y applies the charged voltage to the photoconductor 1Y to uniformly charge the surface of the photoconductor 1Y to a predetermined polarity.

The developing unit 5Y of FIG. 2 develops the electrostatic latent image formed on the surface of the photoconductor 1Y as a single color toner image (yellow toner, in this case). Thus, the toner image is formed on the surface of the photoconductive drum 1Y.

After the yellow toner image formed on the surface of the photoconductor 1Y is transferred onto the surface of the intermediate transfer belt 8, the drum cleaning unit 2Y removes residual toner on the surface of the photoconductor 1Y.

Further, the discharging unit electrically discharges residual charge remaining on the surface of the photoconductor 1Y after cleaning. With the discharging operation, the surface of the photoconductor 1Y is electrically initialized for a subsequent image forming operation.

The above-described operations are preformed by the other process cartridges 6M, 6C, and 6K to form magenta, cyan, and black toner images are formed, respectively, to be transferred onto the intermediate transfer belt 8.

The optical writing unit 7 is disposed below the process cartridges 6Y, 6C, 6M, and 6K in FIG. 1.

The optical writing unit 7 is a part of the image forming mechanism, and emits four laser beams towards the photoconductors 1Y, 1C, 1M, and 1K. When the optical writing unit 7 emits a laser beam L toward the photoconductor 1Y of the process cartridge 6Y in FIG. 1, the laser beam L is deflected by a polygon mirror (not shown) that is also driven by a motor. The laser beam L travels via a plurality of optical lenses and mirrors, and reaches the photoconductor 1Y. The process cartridge 6Y receives the laser beam L, which is optically modulated. The laser beam L, according to image data corresponding to a color of toner for the process cartridge 6Y, irradiates a surface of the photoconductor 1Y through a path formed between the charging unit 4Y and the developing unit 5Y, so that an electrostatic latent image is formed on the charged surface of the photoconductor 1Y.

In FIG. 1, the sheet feed cassette 26 is disposed below the optical writing unit 7 to accommodate multiple recording media such as transfer sheets that include an individual transfer sheet S. The sheet feeding mechanism also includes a sheet feed roller 27 and a pair of registration rollers 28. A combination of the sheet feed roller 27 and the pair of registration rollers 28 form a conveyance mechanism, in which the transfer sheet S is conveyed from the sheet feed cassette 26 that serves as a sheet container to a secondary transfer nip portion.

The sheet feed roller 27 is held in contact with the transfer sheet S. The sheet feed roller 27 is rotated by a roller drive motor (not shown), the transfer sheet S placed on the top of a stack of transfer sheets in the sheet feed cassette 26 is fed and is conveyed to a portion between the pair of registration rollers 28.

The pair of registration rollers 28 stops and feeds the transfer sheet S in synchronization with a movement of the four color toner image towards a secondary transfer area, which is the secondary transfer nip portion formed between the intermediate transfer belt 8 and a secondary transfer roller 19.

The secondary transfer roller 19 is applied with an adequate predetermined transfer voltage such that the four color toner image, formed on the surface of the intermediate transfer belt 8, is transferred onto the transfer sheet S. The four color toner image transferred on the transfer sheet S is referred to as a full color toner image.

In FIG. 1, the transfer unit 15 is arranged above the process cartridges 6Y, 6C, 6M, and 6K. The transfer unit 15 includes an intermediate transfer belt 8, a belt cleaning unit 10, four primary transfer rollers 9Y, 9C, 9M, and 9K, a secondary transfer backup roller 12, a cleaning backup roller 13, and a tension roller 14. The intermediate transfer belt 8 forms an endless belt extending over the secondary transfer backup roller 12, the cleaning backup roller 13, and the tension roller 14, and rotating with at least one of the rollers 12, 13, and 14 in a counterclockwise direction in FIG. 1.

The intermediate transfer belt 8 is held in contact with the primary transfer rollers 9Y, 9C, 9M, and 9K corresponding to the photoconductors 1Y, 1C, 1M, and 1K, respectively, to form primary transfer nips between the photoconductor 1Y and the primary transfer roller 9Y, between the photoconductor 1C and the primary transfer roller 9C, between the photoconductor 1M and the primary transfer roller 9M, and between the photoconductor 1K and the primary transfer roller 9K. Corresponding to the photoconductor 1Y of FIG. 2, the primary transfer roller 9Y is arranged at a position opposite to the photoconductor 1Y such that the toner image formed on the surface of the photoconductor 1Y is transferred onto the intermediate transfer belt 8. The primary transfer roller 9Y rotates in a counterclockwise direction as indicated by an arrow shown in FIG. 2. The primary transfer roller 9Y receives a transfer voltage having an opposite polarity, such as a positive polarity, to the charged toner to transfer the transfer voltage to an inside surface of the intermediate transfer belt 8. The rollers except the primary transfer roller 9 (that is, the primary transfer rollers 9Y, 9C, 9M, and 9K) are electrically grounded.

Through operations similar to those as described above, yellow, cyan, magenta, and black images are formed on the surfaces of the respective photoconductors 1Y, 1C, 1M, and 1K. Those color toner images are sequentially overlaid on the surface of the intermediate transfer belt 8, such that a primary overlaid toner image is formed on the surface of the intermediate transfer belt 8. Hereinafter, the primary overlaid toner image is referred to as a four color toner image.

The secondary transfer backup roller 12 contacts the secondary transfer roller 19 via the intermediate transfer belt 8 to form a secondary transfer nip portion. The four color toner image formed on the intermediate transfer belt 8 is transferred from the intermediate transfer belt 8 to the transfer sheet S at the secondary transfer nip portion.

After the secondary transfer nip portion, the belt cleaning unit 10 removes residual toner adhering on the surface of the intermediate transfer belt 8.

At the secondary transfer nip portion, the transfer sheet S is sandwiched by the intermediate transfer belt 8 and the secondary transfer roller 19, the surfaces of which moving in a forward direction, which is an opposite direction of surface movement of the pair or registration rollers 28.

The transfer sheet S that has the full color toner image thereon is conveyed further upward, and passes between a pair of fixing rollers of the fixing unit 20. The fixing unit 20 includes a heat roller having a heater therein and a pressure roller for pressing the transfer sheet S for fixing the four color toner image. The fixing unit 20 fixes the four color toner image to the transfer sheet S by applying heat and pressure.

After the transfer sheet S passes the fixing unit 20, the transfer sheet S is discharged by a sheet discharging roller 29 to a sheet stacker 30 provided at the upper portion of the printer 100.

As shown in FIG. 1, the toner bottle container 31 is disposed between the intermediate transfer unit 15 and the sheet stacker 30. The toner bottle container 31 serves as a toner feeding mechanism and includes the four toner bottles 32*y*, 32C, 32M, and 32K, which are independently detachable from each other. The toner bottles 32*y*, 32C, 32M, and 32K are also separately provided on the toner bottle container 31 with respect to the respective process cartridges 6Y, 6C, 6M, and 6K, and are detachably arranged to the printer 100. With the above-described configuration, each toner bottle may easily be replaced with a new toner bottle when each toner of the toner bottle is detected as being in a toner empty state, for example.

Figure 3:
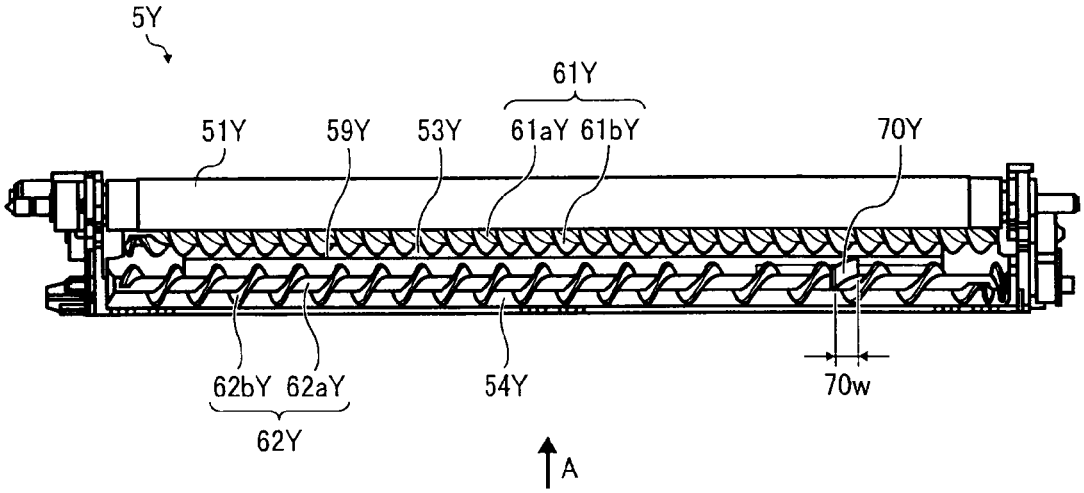
FIG. 3 is a top view of a developing unit of the printer of FIG. 1 when an upper cover is removed therefrom.

Next, a description is given of a configuration of the developing unit 5Y incorporated in the process cartridge 6Y. As previously described, FIG. 2 is a schematic cross-sectional view of the process cartridge 6Y, viewed from an axial direction of a rotary shaft of the photoconductor 1Y. In FIG. 2, a controller 57Y and a drive motor 41Y are schematically illustrated. FIG. 3 is a top view of developing unit 5Y when an upper cover 67Y is removed therefrom.

The developing unit 5Y includes a magnetic field generator, a developing sleeve 51Y, and a developing doctor 52Y.

The developing sleeve 51Y serves as a developer carrying member to carry and convey a two-component developer that includes magnetic particles and toner. The developing doctor 52Y serves as a developer regulating member to regulate a thickness of layer of the two-component developer that is carried and conveyed on the developing sleeve 51Y.

A developer container surrounded by a casing 55Y is disposed below the developing sleeve 51Y. The developer container is separated by a separator 59Y into a first developer container 53Y that supplies the developer to the developing sleeve 51Y and a second developer container 54Y that receives toner from a toner supplier 58Y. The first developer container 53Y is provided with a first conveyance screw 61Y therein to agitate and convey the toner. The second developer container 54Y is provided with a second conveyance screw 62Y therein.

The second conveyance screw 62Y has a configuration in which a screw blade part 62*b*Y is fixedly disposed by protruding in spiral form from a peripheral surface of a rotary shaft member 62*a*Y. Similar to the second conveyance screw 62Y, the first conveyance screw 61Y has a configuration in which a screw blade part 61*b*Y is fixedly disposed by protruding in spiral form from a peripheral surface of a rotary shaft member 61*a*Y. Following the rotation of the first conveyance screw 61Y, the developer in the first developer container 53Y is conveyed from a right-hand side to a left-hand side in FIG. 3, which is from a near side to a far side in FIG. 2, and the developer in the second developer container 54Y is conveyed from a left-hand side to a right-hand side in FIG. 3, which is from a far side to a near side in FIG. 2. Further, both ends of the separator 59Y in the axial direction (a right to left direction in FIG. 3) of the conveyance screw include respective openings so that the developer can circulate between the first developer container 53Y and the second developer container 54Y.

Further, a toner density sensor 56Y is disposed on a lower outer wall of the casing 55Y of the second developer container 54Y so as to detect the toner density of the developer in the second developer container 54Y. The inner wall of the casing 55Y that is opposite to a portion on the outer wall of the casing 55Y where the toner density sensor 56Y is disposed may correspond to a detection surface 80 serving as a detection area of the toner density sensor 56Y. The rotary shaft member 62*a*Y, which is a rotary shaft of the second conveyance screw 62, faces the detection surface 80, where a detection surface cleaning member 70Y (described later) is fixed.

As a non-contact type sensor, the toner density sensor 56Y is not necessary to be disposed at a portion to contact with the developer for detecting and measuring the toner density. An example of such a toner density sensor that can be used in the present invention is disclosed in Japanese Published Patent Application No. JPAP 2004-139038.

Further, the detection surface 80Y corresponds to an area on the inner wall of the casing that forms a developer container in a region where the non-contact type toner density sensor 56Y detects the toner density. That is, a specific member is not provided as a detection surface.

However, the toner density sensor for the present invention is not limited to such a non-contact type sensor. For example, a toner density sensor in which a sensing part thereof is mounted to project from the outside of the casing 55Y to the inside of the casing 55Y can be applied. Alternatively, a toner density sensor can be disposed on the inner wall of the casing 55Y.

Next, operations of the developing unit 5Y are described.

In the developing unit 5Y, the developer in the developer container includes carrier and toner, and the toner is replenished to keep the toner density in a given range. The toner is fed from the toner bottle 32Y, conveyed through a toner conveyance pipe of a toner conveyance unit (not shown), and supplied to the second developer container 54Y via a toner supplier 58Y. Then, the second conveyance screw 62Y and the first conveyance screw 61Y agitate and convey the toner to be mixed with the carrier in the developer, so that the toner is frictionally charged. The developer in the first developer container 53Y, which includes the charged toner, is supplied to a surface of the developing sleeve 51Y that includes a magnetic pole therein. A magnetic force caused by the magnetic pole in the developing sleeve 51Y forms a developer layer to be carried thereon. The developer layer carried on the developing sleeve 51Y is conveyed in a direction indicated by arrow shown on an illustration of the developing 51Y in FIG. 2 as the developing sleeve 51Y rotates. While the thickness of the layer is adjusted by a developing doctor 52Y, the toner is conveyed to a development area facing the photoconductor 1Y.

In the development area, the toner is supplied to a latent image formed on the surface of the photoconductor 1Y to develop the latent image to a visible toner image. The developer layer remaining on the surface of the developing sleeve 51Y is conveyed to an upstream side from the first developer container 53Y in a direction of conveyance of developer as the developing sleeve 51Y rotates.

As toner is consumed with development and the toner density in the developing unit 5Y is decreased, the toner density in the developer in the vicinity of the detection surface 80 may be decreased, and a decrease in toner density is detected by the toner density sensor 56Y and the controller 57Y, which are disposed below the second developer container 54Y. Based on the detection result, the controller 57Y drives the drive motor 41Y of the toner supplying unit (not shown) to replenish toner from the toner conveyance pipe 43Y.

Next, a description is given of a detection surface cleaning member 70Y according to an exemplary embodiment of the present invention. The detection surface cleaning member 70Y rotates with the second conveyance screw 62Y that rotates in a clockwise direction in FIG. 2 to scrape away and agitate developer accumulated on the detection surface 80Y.

Further, the detection surface cleaning member 70Y according to an exemplary embodiment of the present invention is fixedly disposed by protruding from the peripheral surface of the rotary shaft member 62*a*Y. The detection surface cleaning member 70Y has a substantially same degree of orientation or angle as that of the screw blade part 62*b*Y to an axial direction of the rotary shaft member 62*a*Y of the second conveyance screw 62Y. By disposing the detection surface cleaning member 70Y substantially same as the screw blade part 62*b*Y to the rotary shaft member 62*a*Y, the developer can be smoothly conveyed even while the detection surface cleaning member 70Y agitates the developer.

Example 1

Figure 4:
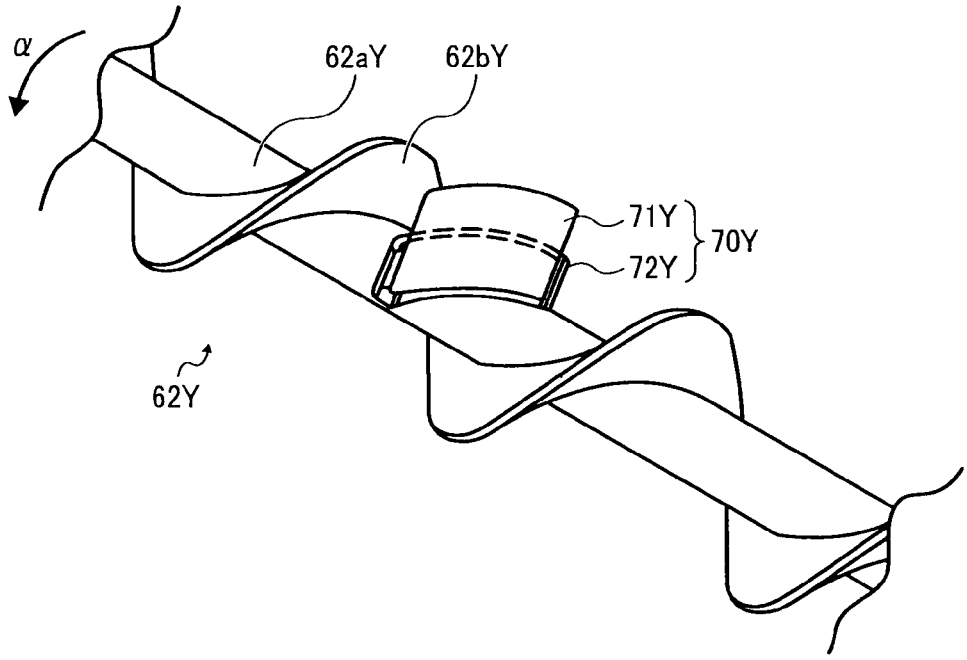
FIG. 4 is an enlarged view illustrating an area in the vicinity of a detection surface cleaning member of a second conveyance screw according to Example 1 of the present invention.
Figure 5:
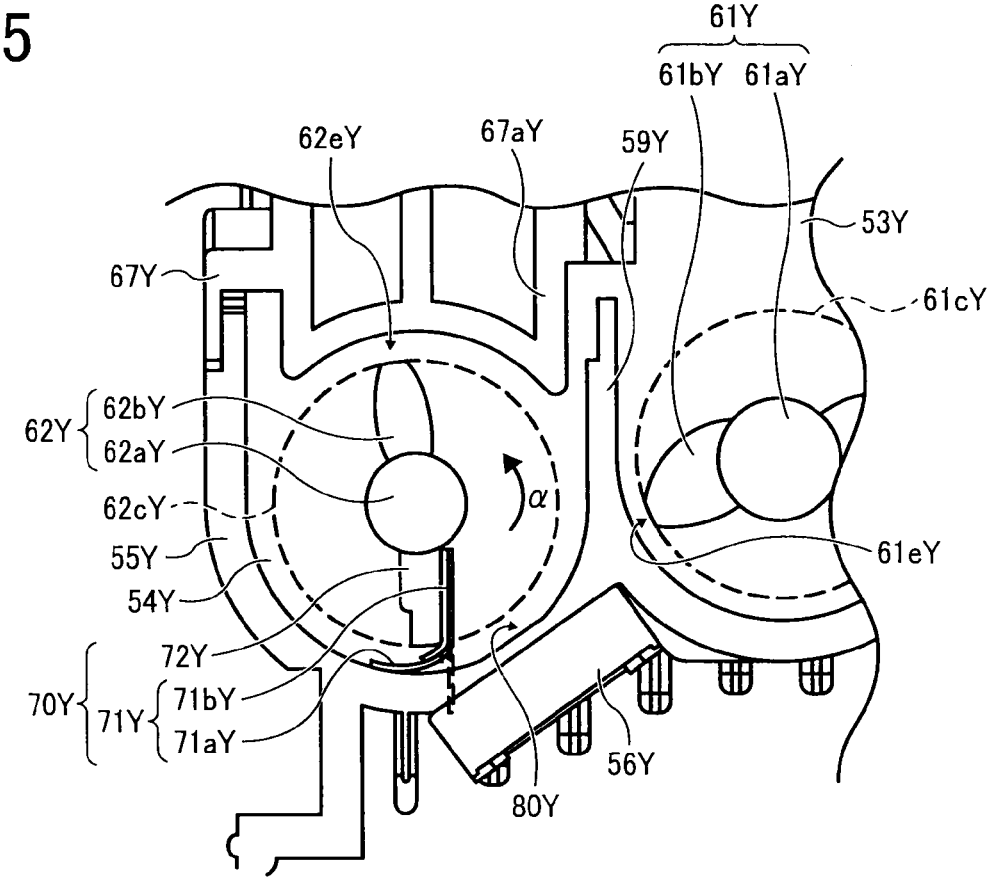
FIG. 5 is an enlarged cross-sectional view illustrating a second developer container with a toner density sensor disposed nearby.
Figure 6:
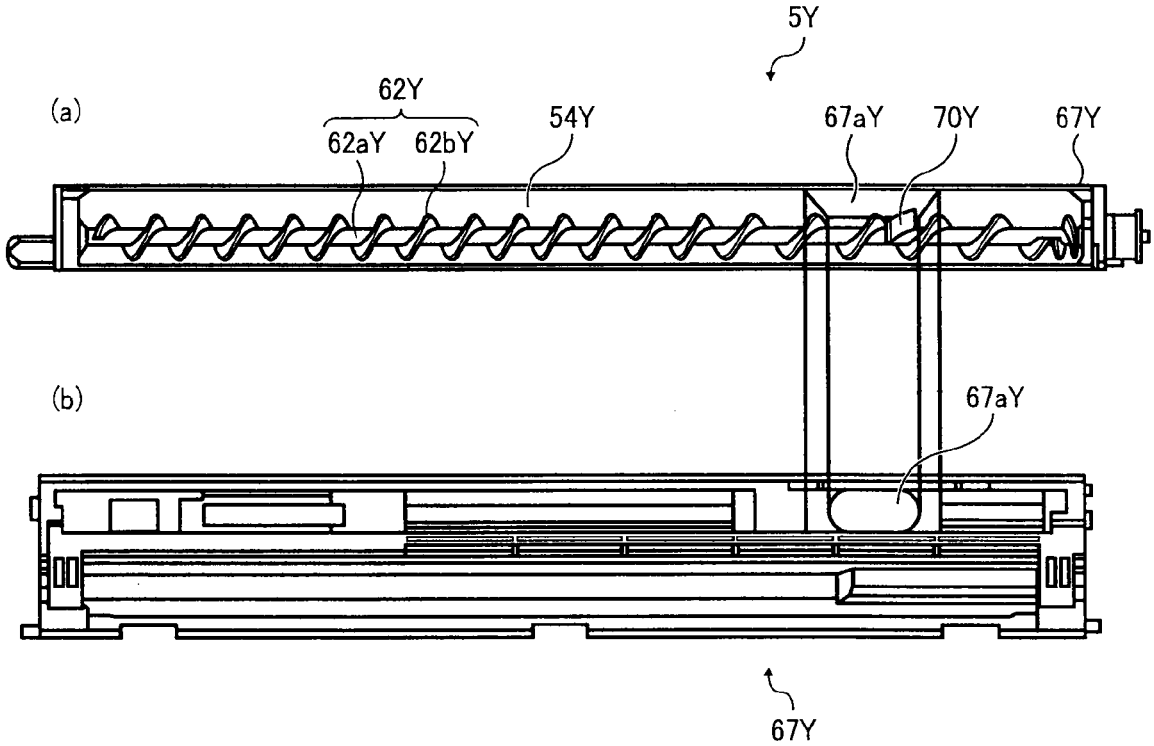
FIG. 6 illustrates the second developer container of FIG. 5, FIG. 6(*a*) is a side view of the second developer container of FIG. 5 for explaining a configuration in which a bottom surface of the upper cover of FIG. 3 in the vicinity of a detection surface of the developing unit of FIG. 3, and FIG. 6(*b*) is a view of a lower surface of the upper cover attached to the second developer container of FIG. 5 for explaining the configuration of FIG. 6(*a*)

Next, referring to FIGS. 4 to 6, descriptions are given of the developing unit 5Y incorporating the detection surface cleaning member 70Y therein according to a first example of the present invention. Hereinafter, the first example is referred to as "Example 1."

FIG. 4 illustrates an enlarged view of an area in the vicinity of the detection surface cleaning member 70Y of the second conveyance screw 62Y of the developing unit 5Y according to Example 1. FIG. 5 illustrates an enlarged cross-sectional view of the second developer container 54Y with the toner density sensor 56Y disposed nearby. In FIG. 5, a dotted line 61*c*Y indicates a path of movement of an outer side 61*e*Y of the first conveyance screw 61Y and a dotted line 62*c*Y indicates a path of movement of an outer side 62*e*Y of the second conveyance screw 62Y.

As shown in FIGS. 4 and 5, the detection surface cleaning member 70Y according to Example 1 includes an elastic sheet 71Y and a fin 72Y. The elastic sheet 71Y is attached to the fin 72Y that serves as a planar member fixedly attached to the rotary shaft member 62*a*Y of the second conveyance screw 62Y. When the second conveyance screw 62Y rotates in a direction indicated by an arrow α as shown in FIG. 4, the elastic sheet 71Y scrapes away and agitates the developer that adheres to the detection surface 80Y. The elastic sheet 71Y according to Example 1 includes, but not limited to, a urethane sheet.

In FIG. 5, the elastic sheet 71Y is illustrated partly by a dotted line to show a state in which the elastic sheet 71Y is not elastically deformed. When the second conveyance screw 62Y that includes the elastic sheet 71Y is attached to the developing unit 5Y, the elastic sheet 71Y is elastically deformed as illustrated by a solid line in FIG. 5 so as to scrape away development accumulated on the detection surface 80Y. By so doing, the developer accumulated on the detection surface 80 can be removed and agitated.

A reference numeral 70*w* in FIG. 3 indicates a width of the detection surface cleaning member 70Y in its axial direction, which is a width of the elastic sheet 71Y in its axial direction in Example 1. The width of the elastic sheet 71Y in FIG. 3 is greater than a width of the detection surface 80Y so that the developer on an entire area or portion of the detection surface 80Y can be agitated as the second conveyance screw 62Y rotates.

Some conventional developing units that employ an elastic sheet serving as a cleaning member to remove developer on a detection surface of a toner density sensor have been disclosed in unexamined and examined Japanese patent applications, for example, in Japanese Patent Laid-open Publication No. 2006-154001. Similar to the developing unit 5Y in this exemplary embodiment, these developing units include the elastic sheet attached to a shaft member of a conveyance screw to contact the elastic sheet to a detection surface of a toner detection portion so as to wipe developer adhering to the detection surface.

However, when the elastic sheet scrapes away and agitates developer on the detection surface, these developing units have increased a difference in a developer density measured before the leading edge of the elastic sheet passes the detection surface and a developer density measured after the leading edge of the elastic sheet passes the detection surface. The increase in the difference in developer densities is caused by that the elastic sheet serving as a detection surface agitating member is fixedly disposed in parallel to the shaft member. In addition, since the difference in developer densities on the detection surface varies depending on such things as linear velocity mode, environment, developer flowability, etc., accuracy in detection of toner density can vary on each user condition.

By contrast, the developing unit 5Y in Example 1, as shown in FIGS. 3 and 4, the elastic sheet 71Y that serves as a detection surface agitating member is disposed to direct in a substantially same orientation or direction as a screw blade part 62*b*Y with respect to a rotary shaft member 62*e*Y of the second conveyance screw 62Y. The above-described arrangement can prevent an increase in developer density of the detection surface 80Y immediately before the leading edge of the elastic sheet 71Y passes the detection surface 80Y to reach the maximum value and a decrease in developer density of the detection surface 80Y immediately after the leading edge of the elastic sheet 71Y has passed the detection surface 80Y to reach the minimum value. By preventing the increase in developer density to the maximum value and the decrease in developer density to the minimum value, the difference in developer densities caused before and after the leading edge of the elastic sheet 71Y passes the detection surface 80Y can be prevented. Further, by preventing the difference in developer densities, the developing unit 5Y of Example 1 can prevent variations of difference in developer densities due to such things as linear velocity mode, environment, developer flowability, etc.

The first conveyance screw 61Y and the second conveyance screw 62Y of Example 1 are formed by resin, and blades thereof are integrally mounted on respective shaft members thereof.

The fin 72Y is also integrally mounted on the second conveyance screw 62Y and is fixed to the rotary shaft member 62*a*Y. The elastic sheet 71Y is glued by adhesive to a surface at a downstream side in a direction of rotation of the fin 72Y.

One of the above-described conventional developing units uses an elastic member having uniform bending rigidity as an elastic sheet to scrape away developer accumulated on the detection surface. If such an elastic member having uniform bending rigidity is used as an elastic sheet, when the bending rigidity is high, the elastic sheet is difficult to be elastically deformed, which was likely to cause aggregated toner due to a pressing force and friction to an inner wall of the detection surfaces and/or casing. Further, when the bending rigidity is low, the elastic sheet may easily bend to developer accumulated on the detection surface, which failed to sufficiently agitate the developer to cause poor agitation.

On the other hand, the developing unit disclosed in Japanese Patent Laid-open Publication No. 2006-154001 employs an elastic sheet such as an elastic member in which the bending rigidity at the fixed side of the elastic sheet is greater than that at the free side or an elastically deformable part of the elastic sheet, so that the elastic sheet can scrape away developer accumulated on the detection surface. By reducing the bending rigidity at the free side of the elastic sheet, the pressing force and friction of the elastic sheet can be reduced so as to prevent to cause aggregated toner. Further, by providing a greater bending rigidity at the fixed side of the elastic sheet, the elastic sheet can be made difficult to be bent by developer accumulated on the detection surface and can prevent poor agitation of the developer.

Similar to the developing unit disclosed in Japanese Patent Laid-open Publication No. 2006-154001, the developing unit 5Y of Example 1 employs the elastic sheet 71Y to have the bending rigidity at the fixed side of the elastic sheet greater than that at the free side.

As shown in FIG. 5, the developing unit 5Y of Example 1 includes two elastic sheets, which are a first sheet 71*a*Y and a second sheet 71*b*Y, glued to each other to form the elastic sheet 71Y. The second sheet 71*b*Y has a top edge thereof that protrudes farther than a top edge of the fin 72Y outwardly from a direction perpendicular to the rotary shaft member 62*a*Y of the second conveyance screw 62Y and is disposed that the top edge thereof does not contact the inner wall of the casing 55Y. The first sheet 71*a*Y has a top edge thereof that protrudes farther than the top edge of the second sheet 71*b*Y outwardly from the direction perpendicular to the rotary shaft member 62*a*Y of the second conveyance screw 62Y and is disposed that the top edge thereof contacts the inner wall of the casing 55Y in an elastically deformed manner to slidably move thereon. According to the above-described configuration, the first sheet 71*a*Y and the second sheet 71*b*Y are fixedly overlapped at an outward portion close to the top side of the fin 72Y, and therefore the elastic sheet 71Y has the bending rigidity at the portion greater than the bending rigidity at the top side of the first sheet 71*a*Y. Accordingly, the developing unit 5Y according to Example 1 can prevent aggregated toner and poor agitation, which is similar to the developing unit disclosed in Japanese Patent Laid-open Publication No. 2006-154001.

Further, when a bulk density of developer in the vicinity of a toner density sensor detection area in a developing unit varies, a magnetic flux density of developer may change even in an identical toner density, which can cause detection error.

To solve the above-described drawbacks, a developing unit disclosed in Japanese Patent Laid-open Publication No. 2003-307918 has disclosed a technique in which variation of the bulk density of developer is reduced by lowering a top board of the developing unit to make a cross-sectional area in a developer conveying path on or in the vicinity of the installation position of the toner density sensor smaller than cross-sectional areas of the other developer conveying paths.

Similar to the above-described developing unit disclosed in Japanese Patent Laid-open Publication No. 2003-307918, the developing unit 5Y according to Example 1 reduces a distance from a lower surface of the upper cover 67Y of the developing unit 5Y to an inner surface of a bottom portion of the second developer container 54 to make a cross-sectional area in the second developer container 54Y on or in the vicinity of the detection surface 80Y smaller than cross-sectional areas of the other second developer container 54Y.

FIG. 6 illustrates drawings for explaining a configuration in which the bottom surface of the upper cover 67Y in the vicinity of the detection surface 80Y. FIG. 6(*a*) illustrates a side view of the second developer container 54Y, viewed from a direction indicated by arrow A shown in FIG. 3. FIG. 6(*b*) illustrates a view of a lower surface of the upper cover 67Y attached to the second developer container 54Y.

As shown in FIGS. 6(*a*) and 6(*b*), the upper cover 67Y includes a protruding part 67*a*Y such that the developing unit 5Y has a specific part of a ceiling or a lower surface of the upper cover 67Y facing the detection surface cleaning member 70Y of the second developer container 54Y that serves as a developer conveyance path can be lower than the other part of the ceiling or the lower surface thereof. As shown in FIG. 5, a cross-section of the protruding part 67*a*Y is formed along a path drawn by an outer side 62*e*Y of the screw blade part 62*b*Y as the second conveyance screw 62Y rotates. By mounting the protruding part 67*a*Y as described above, the cross-sectional area at the protruding part 67*a*Y may become narrower than the cross-sectional areas of the other areas of the second developer container 54Y, which can result in that developer may be more packed when passing the area at or in the vicinity of the protruding part 67*a*Y than when passing the other areas thereof and can cause less variation of the bulk density of developer. Since the detection surface 80Y is located at a position facing the detection surface cleaning member 70Y, the protruding part 67*a*Y disposed as described above can prevent variation of the bulk density of the developer in the vicinity of the detection surface 80Y.

As described above, even though the developing unit 5Y has the configuration that can prevent the variation of the bulk density, the detection surface agitating member can press and flip up developer accumulated on the detection surface 80, which cannot prevent causing the variation of the bulk density. Example 1 has a configuration in which the elastic sheet 71Y that serves as a detection surface agitating member agitates or mixes developer on the detection surface 80Y and the elastic sheet 71Y is directed in a substantially same direction as the screw blade part 62*b*Y with respect to the rotary shaft member 62*a*Y. Therefore, compared to a configuration in which the detection surface agitating member is attached in parallel to the shaft member, the variation of the bulk density caused by the agitating operation of the detection surface agitating member can be reduced.

In this exemplary embodiment and Example 1, the configurations described above have been explained by using the developing unit 5Y and the process cartridge 6Y in use of yellow (Y) toner. However, the same configurations can be applied to the developing units 5M, 5C, and 5K and the process cartridges 6M, 6C, and 6K in use of magenta (M) toner, cyan (C) toner, and black (K) toner.

Example 2

Figure 7:
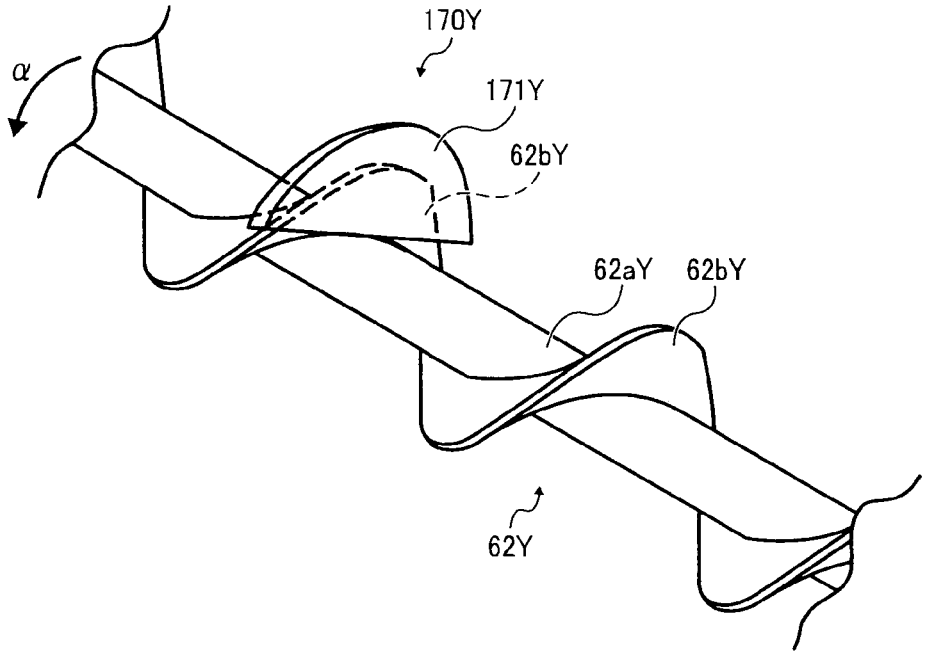
FIG. 7 is an enlarged view illustrating an area in the vicinity of a detection surface cleaning member of a second conveyance screw according to Example 2 of the present invention.

Next, referring to FIG. 7, a description is given of the developing unit 5Y incorporating a detection surface cleaning member 170Y therein according to a second example of the present invention. Hereinafter, the second example is referred to as "Example 2."

FIG. 7 illustrates an enlarged view of an area in the vicinity of the detection surface cleaning member 170Y attached to the second conveyance screw 62Y of the developing unit 5Y according to Example 2. The configuration of the second conveyance screw 62Y of FIG. 7 according to Example 2 is similar to the configuration of the second conveyance screw 62Y of FIG. 4 according to Example 1, except that the structure of the detection surface cleaning member 170Y of Example 2 is different from the structure of the detection surface cleaning member 70Y of Example 1. Elements or components of the developing unit 5Y according to Example 2 may be denoted by the same reference numerals as those of the developing unit 5Y according to Example 1 and the descriptions thereof are omitted or summarized.

As shown in FIG. 7, the detection surface cleaning member 170Y according to Example 2 includes an elastic sheet 171Y that is attached or glued to a part of the second conveyance screw 62Y. When the second conveyance screw 62Y rotates in a direction indicated by an arrow α as shown in FIG. 7, the elastic sheet 171Y scrapes away and agitates the developer that adheres to the detection surface 80Y.

Similar to Example 1, the toner density sensor 56Y is disposed on the lower outer wall of the casing 55Y of the second developer container 54Y so as to detect the density of toner in the developer accommodated in the second developer container 54Y. The inner wall of the casing 55Y that is opposite to a portion on the outer wall of the casing 55Y where the toner density sensor 56Y is disposed may correspond to the detection surface 80 serving as a detection area of the toner density sensor 56Y. The elastic sheet 171Y that scrapes away and agitates the developer accumulated on the detection surface 80Y includes multiple elastic sheets attached to each other, which is same as the elastic sheet 71Y according to Example 1.

The developing unit 5Y of Example 2 can prevent accumulation of developer on the wall surface and reduce a difference in developer densities before and after agitation of developer. Therefore, the screw blade part 62*b*Y is sequentially formed in a direction that does not disturb a flow of developer on the detection surface 80Y that serves as a detection area of the toner density sensor 56Y, and the elastic sheet 71Y is attached or glued to the screw blade part 62*b*Y. The elastic sheet 71Y is fan-shaped so as to cover a detection range of the detection surface 80Y and maintain the over cut amount of the casing 55*y* to the inner wall.

Similar to Example 1, the above-described arrangement of the detection surface cleaning member 170Y according to Example 2 can prevent a difference in a developer density of the detection surface 80Y before the leading side of the elastic sheet 171Y passes the detection surface 80Y and a developer density of the detection surface 80Y after the leading side of the elastic sheet 171Y has passed the detection surface 80Y. Further, by preventing the difference in developer densities, the developing unit 5Y of Example 2 can prevent variations of difference in developer densities due to such things as linear velocity mode, environment, developer flowability, etc., which is similar to Example 1.

By contrast, while the developing unit 5Y according to Example 1 includes the fin 72Y fixedly attached to the rotary shaft member 62*a*Y of the second conveyance screw 62Y, the developing unit 5Y according to Example 2 includes the elastic sheet 171Y attached to the screw blade part 62*b*Y. Therefore, by attaching the elastic sheet 171Y to a position facing the detection surface 80Y, screws manufactured by using a mold of screw without such a fin can achieve a same effect exerted to the screws with the fin.

Since the second conveyance screw 62Y according to Example 1 includes the elastic sheet 71Y not attached to the screw blade part 62*b*Y which is curved but to the fin 72Y with a planar shape, the second conveyance screw 62Y having the elastic sheet 171Y can be manufactured more easily than the second conveyance screw 62Y according to Example 2.

Example 3

Figure 8:
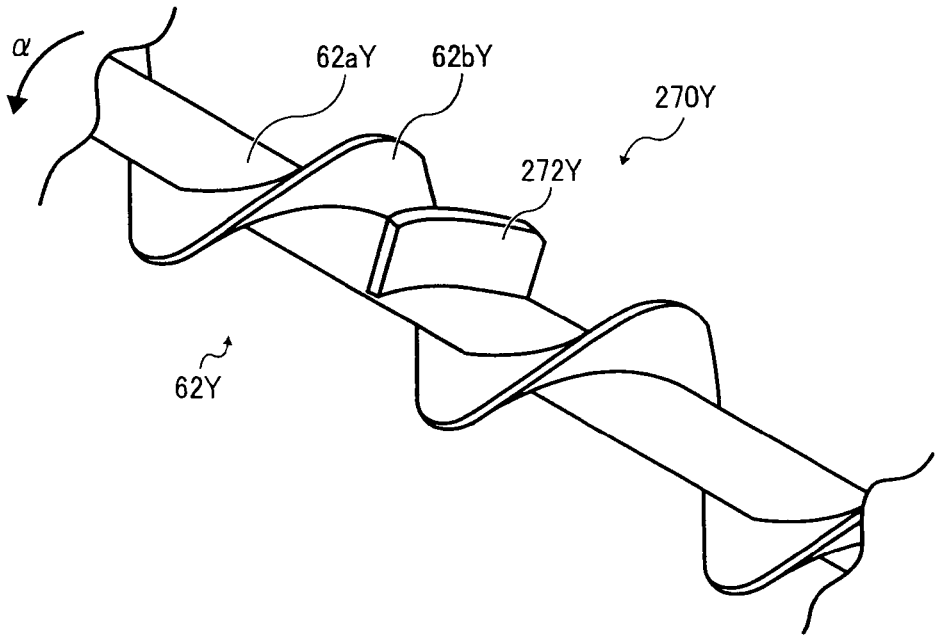
FIG. 8 is an enlarged view illustrating an area in the vicinity of a detection surface cleaning member of a second conveyance screw according to Example 3 of the present invention.

Next, referring to FIG. 8, a description is given of the developing unit 5Y incorporating a detection surface cleaning member 270Y therein according to a third example of the present invention. Hereinafter, the third example is referred to as "Example 3."

FIG. 8 illustrates an enlarged view of an area in the vicinity of the detection surface cleaning member 270Y fixedly attached to the second conveyance screw 62Y of the developing unit 5Y according to Example 3. The configuration of the second conveyance screw 62Y of FIG. 8 according to Example 3 is similar to the configuration of the second conveyance screw 62Y of FIG. 4 according to Example 1, except that the structure of the detection surface cleaning member 270Y of Example 3 is different from the structure of the detection surface cleaning member 70Y of Example 1. Elements or components of the developing unit 5Y according to Example 3 may be denoted by the same reference numerals as those of the developing unit 5Y according to Example 1 and the descriptions thereof are omitted or summarized.

As shown in FIG. 8, the detection surface cleaning member 270Y according to Example 3 includes a fin 272Y that serves as a planar member fixedly attached to the rotary shaft member 62*a*Y of the second conveyance screw 62Y. When the second conveyance screw 62Y rotates in a direction indicated by an arrow α as shown in FIG. 8, the fin 272Y agitates the developer in the second developer container 54Y. An agitation force to agitate the developer is transmitted via the developer to scrape away and agitate the developer on the detection surface 80Y. The fin 272Y is arranged such that a leading side thereof does not contact the inner wall of the casing 55 including the detection surface 80Y.

The configuration according to Example 3 has less agitating ability than the configuration according to Example 1 in which the elastic sheet 71Y scrapes away developer accumulated on the detection surface 80Y. However, since the elastic sheet 71Y is not glued to the fin 272Y in Example 3, a reduction in parts costs and in manufacturing costs can be achieved.

Compared to the configuration in which the fin is fixedly disposed in parallel to the shaft member, the above-described arrangement of the detection surface cleaning member 270Y according to Example 3 can prevent a difference in a developer density of the detection surface 80Y before the leading side of the fin 272Y passes the detection surface 80Y and a developer density of the detection surface 80Y after the leading side of the fin 272Y has passed the detection surface 80Y. Further, by preventing the difference in developer densities, the developing unit 5Y of Example 3 can prevent variations of difference in developer densities due to such things as linear velocity mode, environment, developer flowability, etc., which is similar to Example 1.

Modified Example 1

The upper cover 67Y of the developing unit 5Y according to Example 1 includes the protruding part 67*a*Y to reduce the variation of the bulk density of the developer on the detection surface 80Y such that the cross-sectional area in the vicinity of the detection surface 80Y becomes narrower than the cross-sectional areas of the other areas of the second developer container 54Y.

Figure 9:
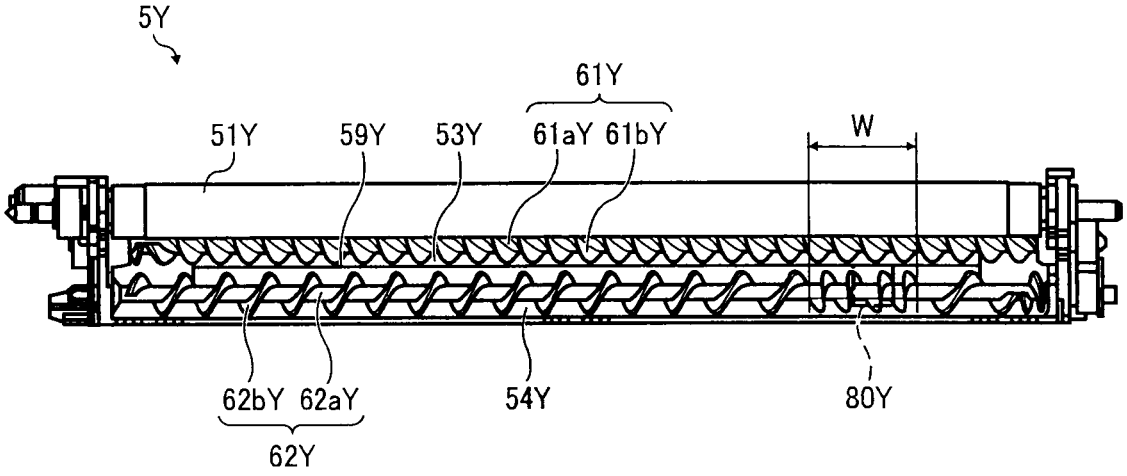
FIG. 9 is a top view illustrating the developing unit of FIG. 3 according to Modified Example 1 of the present invention.

Now, referring to FIG. 9, a description is given of the developing unit 5Y incorporating a second conveyance screw 162Y therein according to a first modified example of the present invention. Hereinafter, the first modified example is referred to as "Modified Example 1." Modified Example 1 provides a configuration to prevent or reduce variation of the bulk density of developer accumulated on the detection surface 80Y by making the cross-sectional area in the vicinity of the detection surface 80Y narrower than the cross-sectional areas of the other parts of the second developer container 54Y.

FIG. 9 illustrates a top view of the developing unit 5Y according to Modified Example 1, with the upper cover 67Y of the developing unit 5Y detached. As shown in FIG. 9, the second conveyance screw 162Y of the developing unit 5Y according to Modified Example 1 includes a screw blade part 162*b*Y having intervals or pitches that are narrower in an area W in the vicinity of the detection surface 80Y than an area other than the area W. By narrowing the pitches in the vicinity of the detection surface 80Y, the developer can stay in the area W to make the developer be more packed therein, which can cause less variation of the bulk density of developer. Since the detection surface 80Y is located at a position facing the detection surface cleaning member 70Y, the protruding part 67*a*Y disposed as described above can prevent variation of the bulk density of the developer in the vicinity of the detection surface 80Y.

The detection surface cleaning member 70Y according to Modified Example 1 can be applied to any of the configurations of Examples 1, 2, and 3.

[Test 1]

Next, a description is given of results of Test 1 that compared a sensor detection characteristic of each standard of agitation structure.

A unit testing machine prepared as a developing unit used in Test 1 has a same structure as the developing unit 5 in this exemplary embodiment. Three screws, which include the detection surface cleaning member 70 having respective angles or respective structures of agitation different from each other, are prepared alternatively as the second conveyance screw 62 of the developing unit 5. With the above-described machine and screws, Test 1 was conducted to compare and evaluate detection outputs of a toner density sensor when values of linear velocities and toner densities of different second conveyance screws A62, B62, and C62 are allocated or distributed at a given level, and the results were described below.

The structures of agitation used in Test 1 were described as Conventional Example, Test Example, and Comparative Example.

Conventional Example: A detection surface cleaning member A70 was fixed in parallel to the rotary shaft member 62*a* of the second conveyance screw A62.

Test Example: Same as the second conveyance screw 62 according to Example 1 of this exemplary embodiment, a detection surface cleaning member B70 was fixedly disposed at the substantially same angle as the screw blade part 62*b* with respect to an axial direction of the rotary shaft member 62*a* of the second conveyance screw B62 that corresponds to the second conveyance screw 62 according to Example 1.

Comparative Example: A detection surface cleaning member C70 was fixedly disposed at a degree of orientation or angle opposite to the screw blade part 62*b* with respect to an axial direction of the rotary shaft member 62*a* of the second conveyance screw C62.

Figure 10:
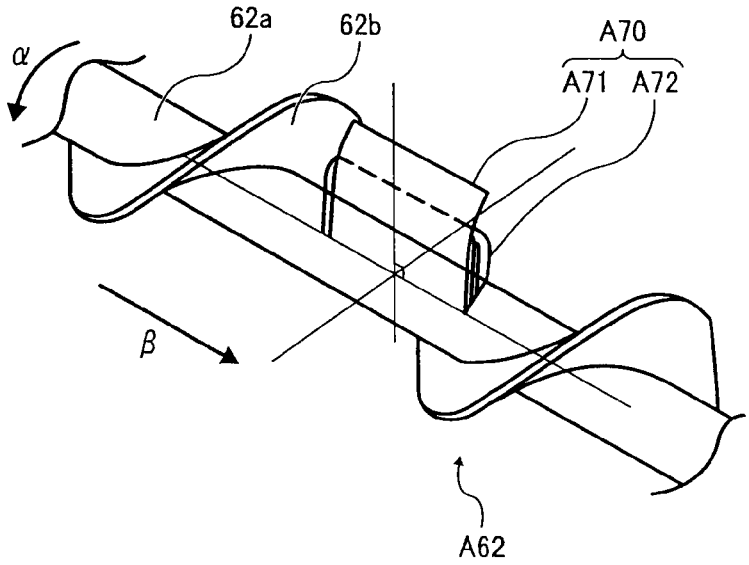
FIG. 10 is an enlarged view of an area in the vicinity of a detection surface cleaning member of a second conveyance screw according to Conventional Example in Test 1.
Figure 11:
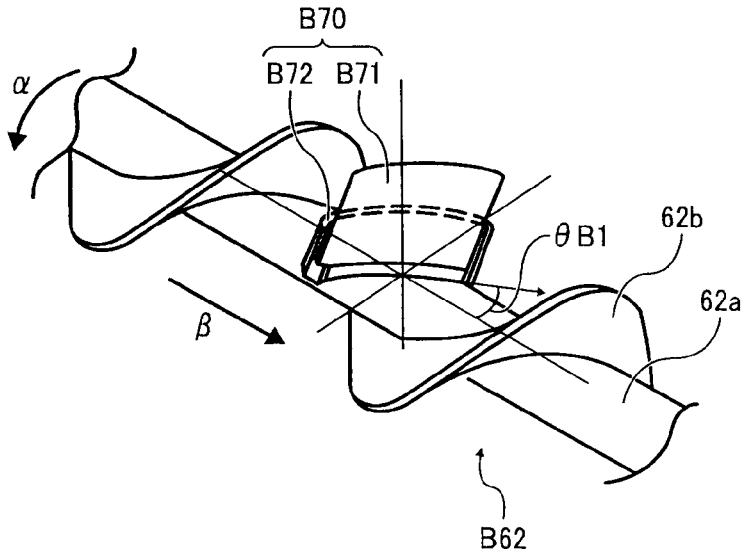
FIG. 11 is an enlarged view of an area in the vicinity of a detection surface cleaning member of a second conveyance screw according to Test Example in Test 1.
Figure 12:
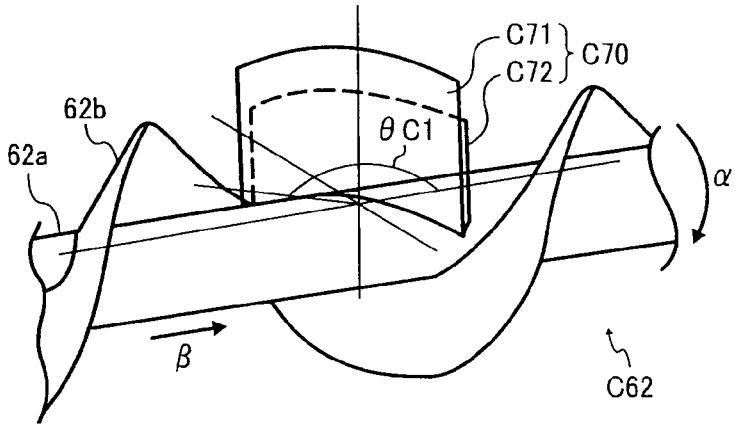
FIG. 12 is an enlarged view of an area in the vicinity of a detection surface cleaning member of a second conveyance screw according to Comparative Example in Test 1.

FIGS. 10 to 12 illustrate respective drawings for explaining the structures of the second conveyance screws A62, B62, and C62 for Conventional Example, Test Example, and Comparative Example.

FIG. 10 illustrates an enlarged view of an area in the vicinity of the detection surface cleaning member A70 of the second conveyance screw A62 of the developing unit 5 according to Conventional Example. As shown in FIG. 10, the detection surface cleaning member A70 according to Conventional Example includes an elastic sheet A71 and a fin A72. The fin A72 of the detection surface cleaning member A70 is disposed in parallel to an axial direction of the rotary shaft member 62*a*, regardless of the degree of angle of the screw blade part 62*b*. The elastic sheet A71 is attached to the fin A72 at a downstream side in a direction or rotation, which is indicated by arrow α in FIG. 10, of the fin A72. When an angle formed by a line drawn from a position where the fin A72 is disposed toward a direction of conveyance of developer, which is indicated by arrow β in FIG. 10, and a surface of the elastic sheet A71 is represented as "θA1", a relation shown as "θA1=0 degree" can be satisfied. That is, a direction of the width of the detection surface cleaning member A70 is substantially same as the axial direction of the second conveyance screw A62.

FIG. 11 illustrates an enlarged view of an area in the vicinity of the detection surface cleaning member B70 of the second conveyance screw B62 of the developing unit 5 according to Test Example. As shown in FIG. 11, the detection surface cleaning member B70 according to Test Example includes an elastic sheet B71 and a fin B72. The fin B72 is disposed at a substantially same degree of orientation or angle as the screw blade part 62*b* with respect to an axial direction of the rotary shaft member 62*a* of the second conveyance screw B62. The elastic sheet B71 is attached to the fin B72 at a downstream side in a direction or rotation, which is indicated by arrow α in FIG. 11, of the fin B72. When an angle formed by a line drawn from a position where the fin B72 is disposed toward a direction of conveyance of developer, which is indicated by arrow β in FIG. 11, and a surface of the elastic sheet B71 is represented as "θB1", a relation shown as "0 degree<θB1<90 degrees" can be satisfied. In Test Example, a relation "θB1=30 degrees" can be satisfied according to the reasons described below.

A diameter of the rotary shaft member 62*a* of Test Example was set to 5.0 mm and a length in an axial direction of the second conveyance screw B62 on the detection surface 80 of the developing unit 5 was 8.5 mm. In such a configuration, by disposing to incline by the angle θB1 of 30 degrees to the axial direction of the rotary shaft member 62*a*, the detection surface cleaning member B70 can slidably move on an overall area of the detection surface 80 and can visually confirm an entire part of the detection surface cleaning member 70 when viewing the second conveyance screw B62 from a specific direction. Specifically, a range of area to visually confirm the second conveyance screw B62 is a surface of a semicircular part of cross-section of the second conveyance screw B62. Therefore, a length of a fixed side or a side fixed to the rotary shaft member 62*a* of the fin B72 extending in a direction perpendicular to an axial direction of the rotary shaft member 62*a* is 5.0 mm or smaller of the diameter of the rotary shaft member 62*a*. Further, a length of the fixed side of the fin B72 extending in the axial direction of the rotary shaft member 62*a* to slidably move on the entire part of the detection surface 80 is 8.5 mm. In this exemplary embodiment, a maximum value of the angle θB1 to satisfy the above-described conditions is calculated as follows: $\theta B1=\tan^{-1}(5.0/8.5)\approx 30$ degree.

FIG. 12 illustrates an enlarged view of an area in the vicinity of the detection surface cleaning member C70 of the second conveyance screw C62 of the developing unit 5 according to Comparative Example. As shown in FIG. 12, the detection surface cleaning member C70 according to Comparative Example includes an elastic sheet C71 and a fin C72. The fin C72 is disposed at the degree of orientation or angle opposite to the screw blade part 62*b* with respect to an axial direction of the rotary shaft member 62*a* of the second conveyance screw C62. The elastic sheet C71 is attached to the fin C72 at a downstream side in a direction or rotation, which is indicated by arrow α in FIG. 12, of the fin C72. When an angle formed by a line drawn from a position where the fin C72 is disposed toward a direction of conveyance of developer, which is indicated by arrow β in FIG. 12, and a surface of the elastic sheet C71 is represented as "θC1", a relation shown as "90 degrees<θC1<180 degrees" can be satisfied. In Comparative Example, a relation "θC1=150 degrees" can be satisfied.

Following procedures are test conditions applied to the developing unit after the screws having different structures of agitation are set thereto.

1. Set the developing unit that contains developer having the toner density of 7 wt % to the unit testing machine.

2. Wire the input and output of a toner density sensor.

3. Drive the unit testing machine at a number of rotation corresponding to 230 mm/s of linear velocity and adjust a control voltage Vcnt, which is a voltage to input to the toner density sensor, to satisfy an equation: a sensor output Vt (an average value of two cycles of the second conveyance screw)=2.70V±0.02V.

However, when measuring values output from the toner density sensor under the condition of each linear velocity to compare the allocated values of the linear velocity, an average value of sufficiently long times with respect to a time of rotation of the second conveyance screw is recorded as an average sensor output value Vt_ave.

4. Record the sensor output values when the linear velocity v equals to 230 mm/s, 154 mm/s, 115 mm/s, and 77 mm/s.

5. Execute Procedure 4 when the toner density or toner concentration (TC) equals to 4 wt %, 10 wt %, and 12 wt %.

6. According to the data obtained by performing Procedures 1 to 5, develop TC-Vt characteristics that indicate a relation between the toner density and the sensor output value, and characteristics of linear velocity shift volume ΔVt, which indicates a difference in sensor output values depending on a difference in linear velocities in each toner density as sensor detection characteristics.

The target maximum value of the linear velocity shift volume ΔVt in Test 1 was set to 0.8V or smaller according to the following reasons.

A range of voltage that can be detected by the toner density sensor 56 used in Test 1 is from 0V to 5V. When the voltage is out of range, the toner density sensor 56 cannot detect the toner density.

The maximum value of voltage, 5V, can be detected by the toner density sensor 56 even when a linear velocity is shifted under the conditions, for example, that the toner density decreases, that the temperature and humidity increase, and that the sensor outputs distribute in a high sensitive area. Therefore, the target maximum value of the linear velocity shift volume ΔVt in Test 1 was set to 0.8V or smaller so as to maintain the safety margin.

Figure 13A:
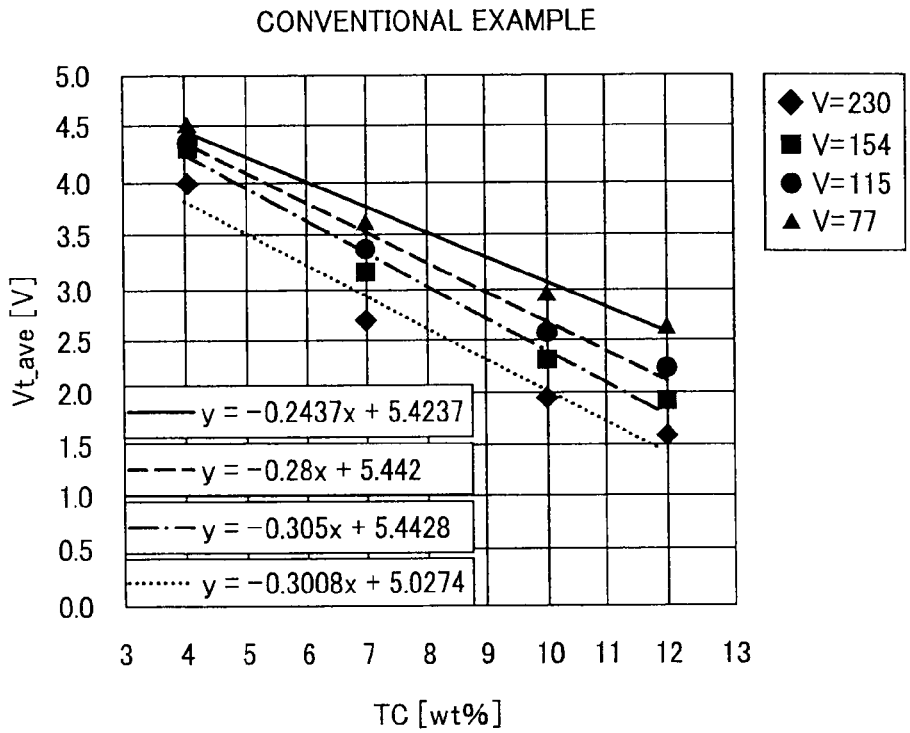
FIGS. 13A and 13B are graphs indicating results in Test 1 according to Conventional Example, specifically.
Figure 13B:
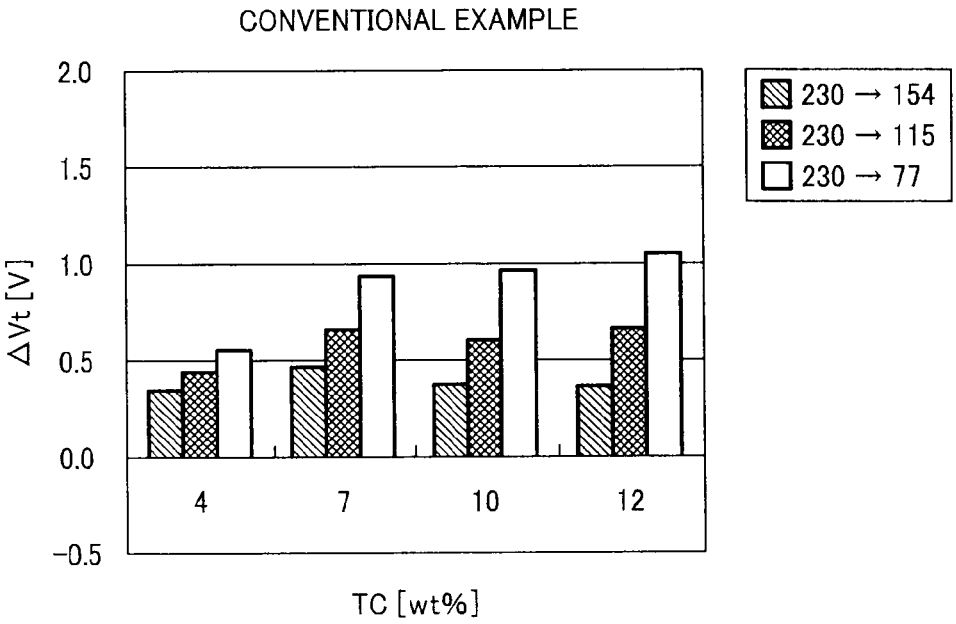

FIGS. 13A and 13B are graphs showing test results of Conventional Example in Test 1. That is, FIG. 13A is a graph indicating the TC-Vt characteristics, and FIG. 13B is a graph indicating the characteristics of the linear velocity shift volume ΔVt.

FIG. 13A shows respective absolute values obtained by subtracting the average sensor output Vt_ave of a linear velocity v other than 230 mm/s of each toner density, from the average sensor output Vt_ave of the linear velocity v of 230 mm/s of each toner density. Specifically, in reference to the bar graph of FIG. 13B, respective bars with diagonal lines indicate absolute values obtained by subtracting the average sensor output Vt_ave of the linear velocity v of 154 mm/s from the average sensor output Vt_ave of the linear velocity v of 230 mm/s. Respective bars with grid patterns indicate absolute values obtained by subtracting the average sensor output Vt_ave of the linear velocity v of 115 mm/s from the average sensor output Vt_ave of the linear velocity v of 230 mm/s. Respective bars of white without any pattern indicate absolute values obtained by subtracting the average sensor output Vt_ave of the linear velocity v of 77 mm/s from the average sensor output Vt_ave of the linear velocity v of 230 mm/s.

According to FIG. 13A, when the linear velocity v was 230 mm/s, the TC-Vt characteristics obtained through the developing unit employing Conventional Example was approximately 0.30 V/mt %. When the linear velocity v was 77 mm/s, the TC-Vt characteristics was approximately 0.24 V/mt %. Accordingly, it was confirmed that the TC-Vt characteristics may degrade when the linear velocity v is low. Further it was confirmed that, even when a high toner density degrades the flowability of developer or toner, the linearity of sensitivity was maintained, which means accumulation of developer does not occur on the detection surface 80.

According to FIG. 13B, when the toner density becomes 7 wt % or greater, the value of the linear velocity shift volume ΔVt can exceed 0.8V, which is a target value.

Figure 14A:
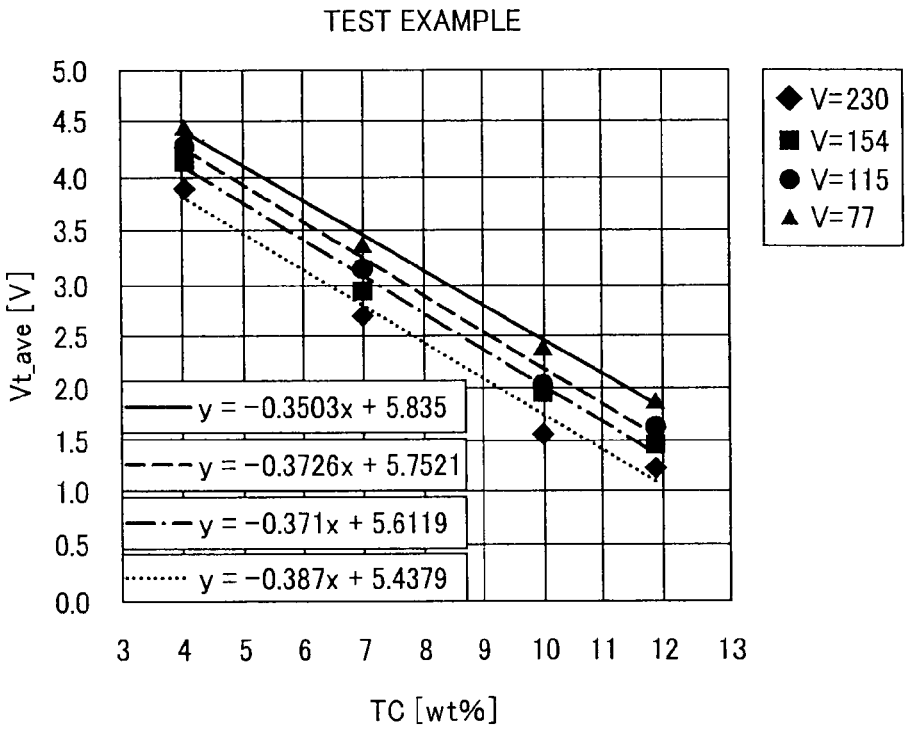
FIGS. 14A and 14B are graphs indicating results in Test 1 according to Test Example, specifically.
Figure 14B:
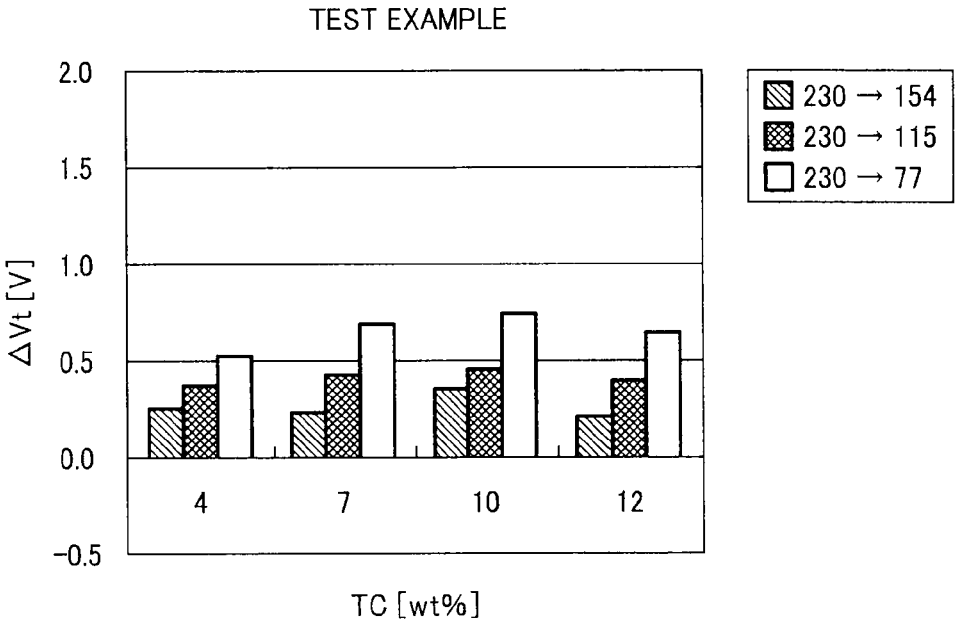

FIGS. 14A and 14B are graphs showing test results of Test Example in Test 1. That is, FIG. 14A is a graph indicating the TC-Vt characteristics, and FIG. 14B is a graph indicating the characteristics of the linear velocity shift volume ΔVt. The results of values of the linear velocity shift volume ΔVt shown in FIG. 14B were calculated in a same manner as the calculation conducted to obtain the values shown in FIG. 13B.

According to FIG. 14A, it was confirmed that, regardless of the linear velocities v, the TC-Vt characteristics obtained through the developing unit employing Test Example was approximately 0.34 V/mt %. Further it was confirmed that, even when a high toner density degrades the flowability of developer or toner, the linearity of sensitivity was maintained, which means accumulation of developer does not occur on the detection surface 80.

Further, according to FIG. 14B, it was confirmed that the value of the linear velocity shift volume ΔVt maintained in the target value, which is 0.8V, or smaller in the range where Test 1 was conducted.

Figure 15A:
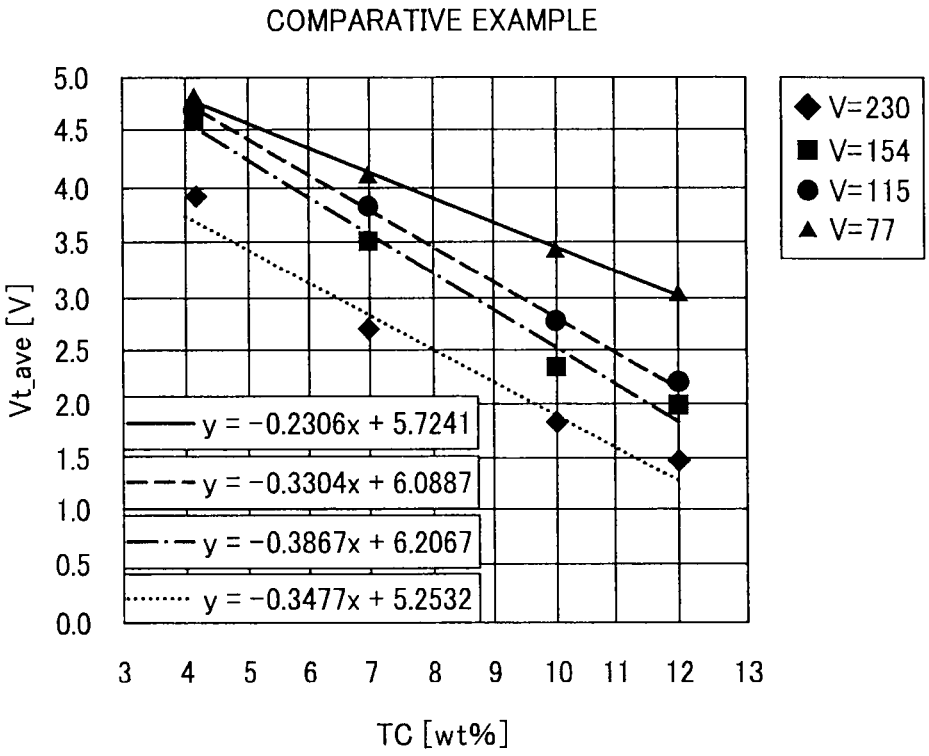
FIGS. 15A and 15B are graphs indicating results in Test 1 according to Comparative Example, specifically.
Figure 15B:
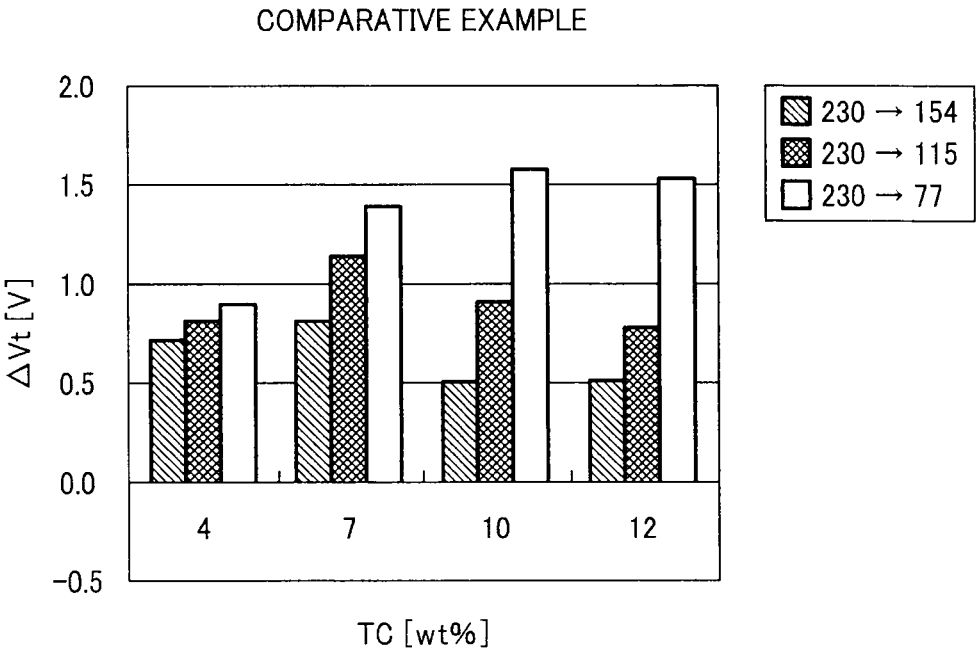

FIGS. 15A and 15B are graphs showing test results of Comparative Example in Test 1. That is, FIG. 15A is a graph indicating the TC-Vt characteristics, and FIG. 15B is a graph indicating the characteristics of the linear velocity shift volume ΔVt. The results of values of the linear velocity shift volume ΔVt shown in FIG. 15B were calculated in a same manner as the calculation conducted to obtain the values shown in FIG. 13B.

According to FIG. 15A, when the linear velocity v was 230 mm/s, the TC-Vt characteristics obtained through the developing unit employing Comparative Example was approximately 0.35 V/mt %. When the linear velocity v was 77 mm/s, the TC-Vt characteristics was approximately 0.23 V/mt %. Accordingly, it was confirmed that the TC-Vt characteristics may degrade when the linear velocity v is low and the TC-Vt characteristics vary with respect to each linear velocity v. Further it was confirmed that, even when a high toner density degrades the flowability of developer or toner, the linearity of sensitivity was maintained, which means accumulation of developer does not occur on the detection surface 80.

According to FIG. 15B, it was found that the value of the linear velocity shift volume ΔVt can exceed the target value of 0.8V in all ranges in Test 1. In addition, it was found that, when the toner density becomes 7 wt % or greater, the value of the linear velocity shift volume ΔVt can considerably exceed 0.8V.

Further, under the condition in which the toner density is greater than 9%, developer overflowed at an upstream side in a direction of conveyance of developer with respect to the protruding part 67*a*.

[Test 2]

Next, a description is given of results of Test 2 that compared waveforms of the sensor outputs Vt by each standard of agitation structure. In Test 2, the three screws used in Test 1, which are the second conveyance screws A62, B62, and C62, were used.

Following procedures are test conditions applied to the developing unit.

1. Attach the second conveyance screw A62 and set the developing unit that contains developer having the toner density of 7 wt % to the unit testing machine.

2. Wire the input and output of a toner density sensor.

3. Calibrated Condition: Drive the unit testing machine at a number of rotation corresponding to 230 mm/s of linear velocity and adjust a control voltage Vcnt, which is a voltage to input to the toner density sensor, to satisfy an equation: a sensor output Vt (an average value of two cycles of the second conveyance screw)=2.70V±0.02V.

4. Measure a waveform of the sensor output Vt at the linear velocity of 230 mm/s by using an oscilloscope.

5. Measure a waveform of the sensor output Vt at the linear velocity of 77 mm/s by using the oscilloscope.

6. Calibrated Conditions: Change the second conveyance screw A62 to the second conveyance screw B62 and to the second conveyance screw C62 with the toner density of 7 wt % and, similar to the above-described procedures 4 and 5 described above, measure respective waveforms of the sensor output Vt at the linear velocities of 230 mm/s and 77 mm/s. The control voltage Vcnt obtained in the above-described procedures 1 to 3 is used for a control voltage (to input to the toner density sensor) of the unit testing machine with the replaced unit.

7. Compare a graph showing the measurement results obtained in the above-described procedures 4 and 5 and a graph showing the measurement results obtained in the above-described procedure 6.

The control voltage Vcnt obtained in the above-described procedures 1 to 3 was 4.05V.

Figure 16A:
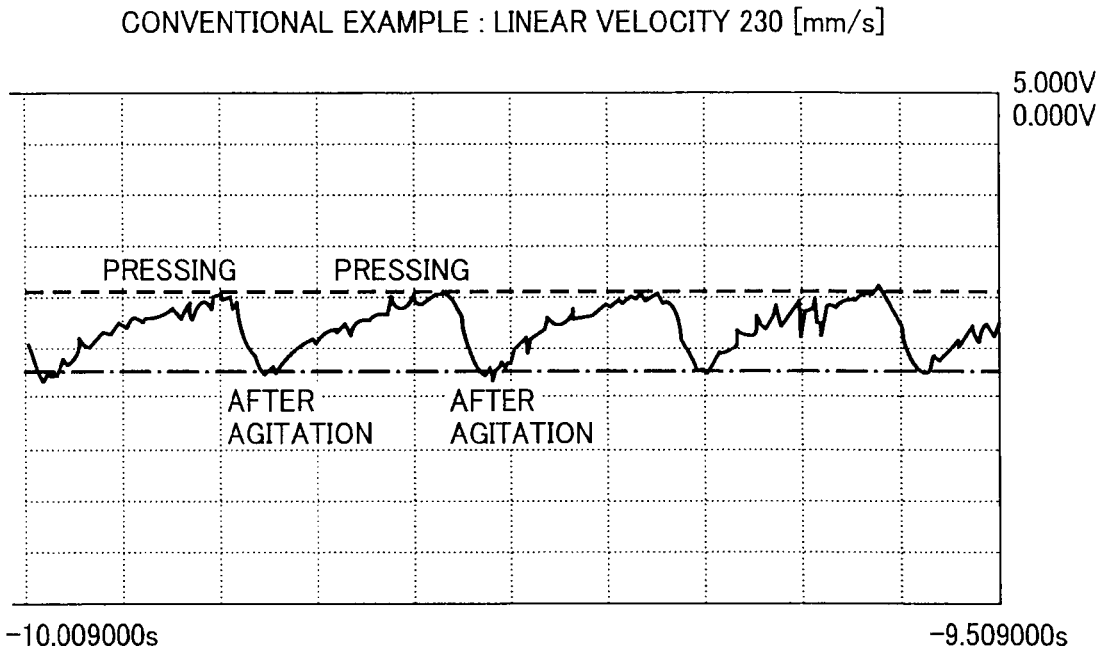
FIG. 16A is a graph showing a waveform of a sensor output Vt which indicates results in Test 2 according to Conventional Example, when the linear velocity "v" is 230 mm/s.
Figure 17A:
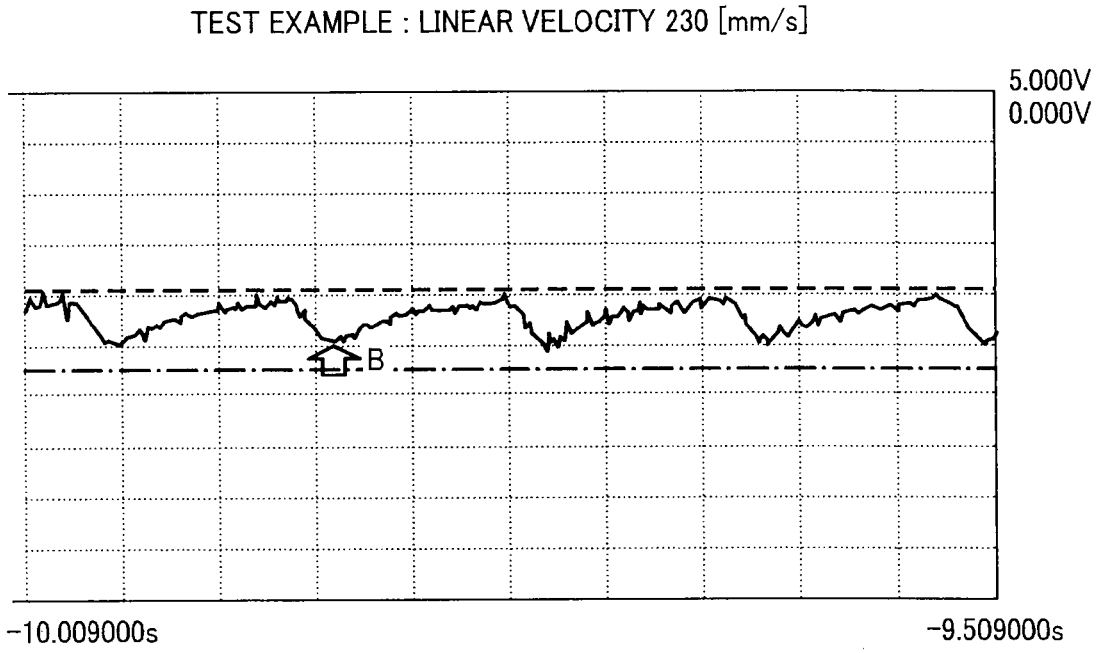
FIG. 17A is a graph showing a waveform of a sensor output Vt which indicates results in Test 2 according to Test Example, when the linear velocity "v" is 230 mm/s.
Figure 18A:
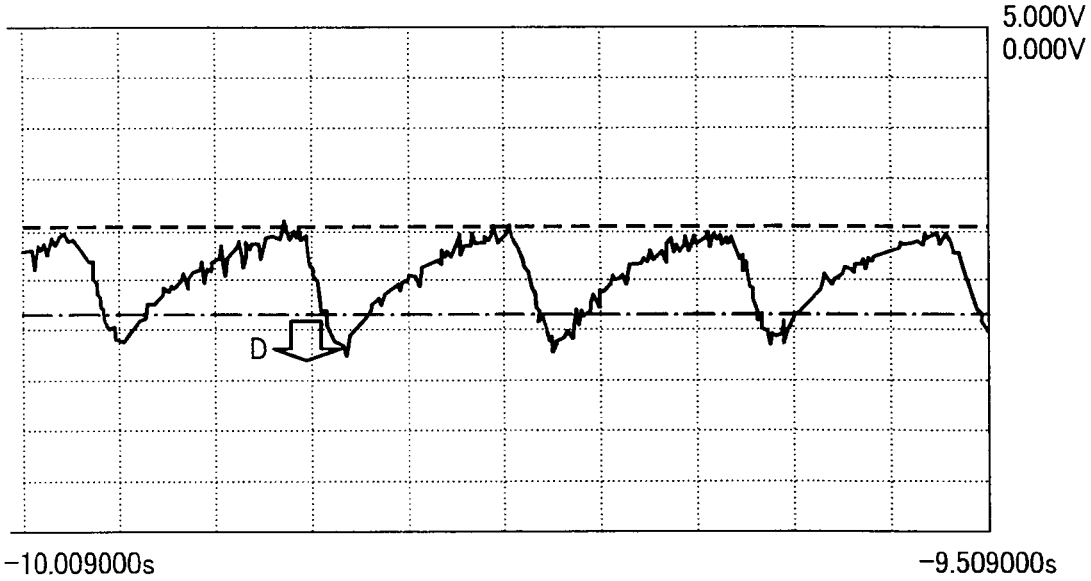
FIG. 18A is a graph showing a waveform of a sensor output Vt which indicates results in Test 2 according to Comparative Example, when the linear velocity "v" is 230 mm/s.

FIGS. 16A, 17A, and 18A illustrate waveforms of the sensor outputs Vt of the screws of respective agitation structures at the linear velocity of 230 mm/s obtained in the above-described procedures 4 and 6. A maximum value of the sensor output during a pressing operation performed until a timing immediately before the elastic member 71 passes the detection surface 80 is determined as the maximum sensor output Vt_max_1. The maximum sensor output Vt_max_1 of Conventional Example is illustrated as a dashed line in each graph. Further, a minimum value of the sensor output during a pressing operation performed immediately after the elastic sheet 71 has scraped away and agitated the developer on the detection surface 80 is determined as the minimum sensor output Vt_min_1. The minimum sensor output Vt_min_1 of Conventional Example is illustrated as a dashed-dotted line in each graph.

Figure 16B:
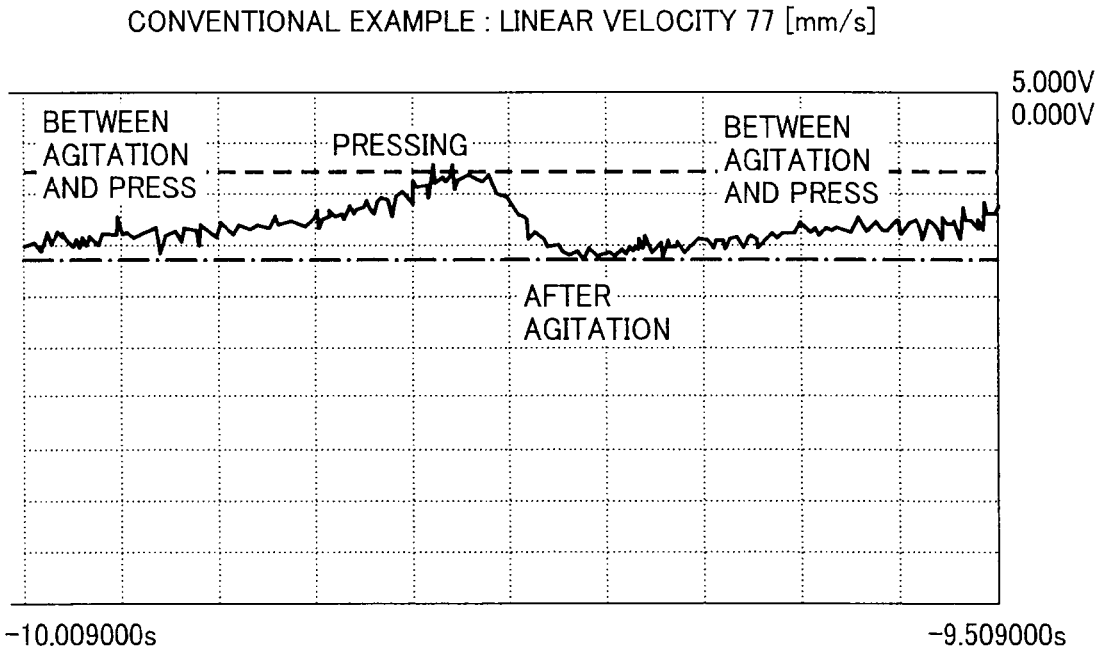
FIG. 16B is a graph showing a waveform of a sensor output Vt which indicates results in Test 2 according to Conventional Example, when the linear velocity "v" is 77 mm/s.
Figure 17B:
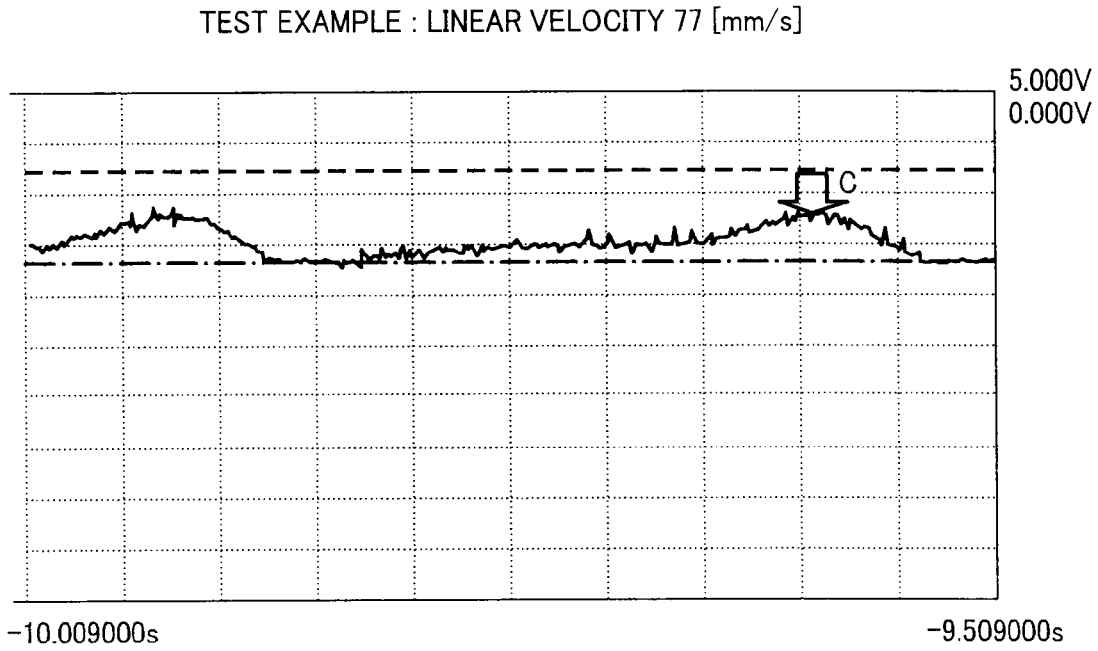
FIG. 17B is a graph showing a waveform of a sensor output Vt which indicates results in Test 2 according to Test Example, when the linear velocity "v" is 77 mm/s.
Figure 18B:
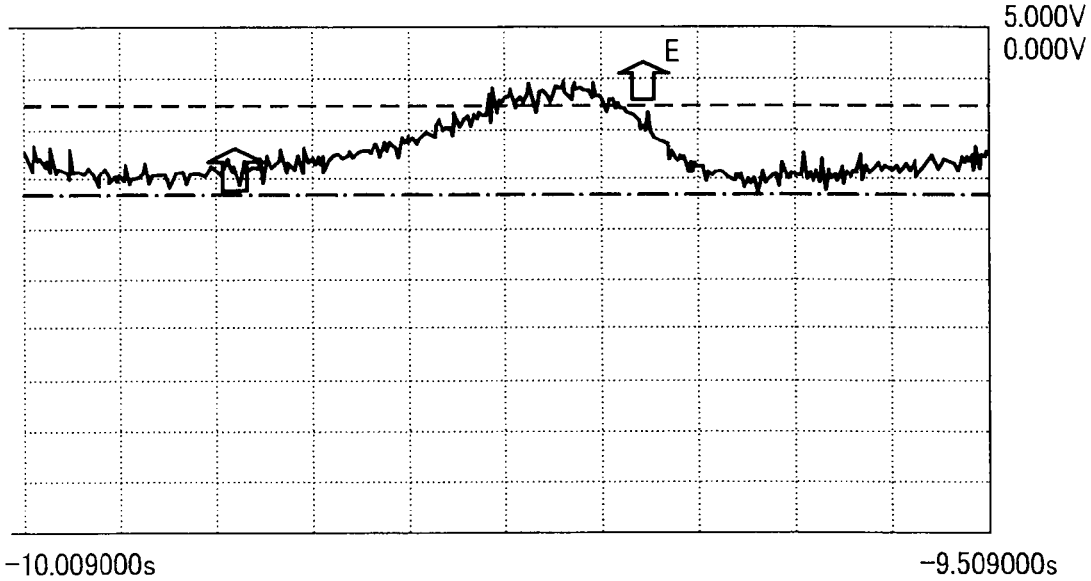
FIG. 18B is a graph showing a waveform of a sensor output Vt which indicates results in Test 2 according to Comparative Example, when the linear velocity "v" is 77 mm/s.

FIGS. 16B, 17B, and 18B illustrate waveforms of the sensor outputs Vt of the screws of respective agitation structures at the linear velocity of 77 mm/s obtained in the above-described procedures 5 and 6. A maximum value of the sensor output during a pressing operation performed until a timing immediately before the elastic sheet 71 passes the detection surface 80 is determined as the maximum sensor output Vt_max_2. The maximum sensor output Vt_max_2 of Conventional Example is illustrated as a dashed line in each graph. Further, a minimum value of the sensor output during a pressing operation performed immediately after the elastic sheet 71 has scraped away and agitated the developer on the detection surface 80 is determined as the minimum sensor output Vt_min_2. The minimum sensor output Vt_min_2 of Conventional Example is illustrated as a dashed-dotted line in each graph.

FIGS. 16A and 16B are graphs showing test results of Conventional Example in Test 2. That is, FIG. 16A is a graph indicating a waveform of the sensor output Vt when the linear velocity v is 230 mm/s, and FIG. 16B is a graph indicating a waveform of the sensor output Vt when the linear velocity v is 77 mm/s.

As shown in FIG. 16A, when the linear velocity v was 230 mm/s, the maximum sensor output Vt_max_1 obtained when the developer density is highest was Vt≈3.0V and the minimum sensor output Vt_min_1 obtained when the developer density is lowest was Vt≈2.2V.

By contrast, as shown in FIG. 17A, when the linear velocity v was 77 mm/s, the maximum sensor output Vt_max_2 obtained when the developer density is highest was Vt≈4.2V and the minimum sensor output Vt_min_2 obtained when the developer density is lowest was Vt≈3.3V.

FIGS. 17A and 17B are graphs showing test results of Test Example in Test 2. That is, FIG. 17A is a graph indicating a waveform of the sensor output Vt when the linear velocity v is 230 mm/s in Test Example, and FIG. 17B is a graph indicating a waveform of the sensor output Vt when the linear velocity v is 77 mm/s in Test Example.

As shown in FIG. 17A, when the linear velocity v is 230 mm/s, the maximum sensor output Vt_max_1 obtained when the developer density is highest was equal to the value in Conventional Example, which is Vt≈3.0V. By contrast, the minimum sensor output Vt_min_1 obtained when the developer density is lowest was increased or became greater than the value in Conventional Example, as indicated by arrow B in FIG. 17A. This result was obtained by attaching the detection surface cleaning member B70 to the substantially same direction as the screw blade part 62*b*. That is, the detection surface cleaning member B70 was disposed to have a given angle (θB1) to the axial direction of the rotary shaft member 62*a* of the second conveyance screw B62. With this structure, the developer was conveyed smoothly and airspace was less generated. Since the maximum sensor output Vt_max_1 was same as that of Conventional Example and the minimum sensor output Vt_min_1 was increased or became greater than that of Conventional Example, the average sensor output Vt_ave may increase under the condition of linear velocity v=230 mm/s in Test Example compared to Conventional Example.

As shown in FIG. 17B, when the linear velocity v is 77 mm/s, the maximum sensor output Vt_max_2 obtained when the developer density is highest was decreased or became smaller than the value in Conventional Example, as indicated by arrow C in FIG. 17B. By contrast, the minimum sensor output Vt_min_2 obtained when the developer density is lowest was equal to the value in Conventional Example. The maximum sensor output Vt_max_2 decreased because, by attaching the detection surface cleaning member B70 to have a given angle (θB1) to the axial direction of the rotary shaft member 62*a* of the second conveyance screw B62, developer on the detection surface 80 during the pressing operation moved toward a downstream side in a direction of conveyance of developer of the second conveyance screw 62B, which decreased the concentration of the developer pressed on the detection surface 80. Since the maximum sensor output Vt_max_2 was decreased or became lower than that of Conventional Example and the minimum sensor output Vt_min_2 was same as that of Conventional Example, the average sensor output Vt_ave may decrease under the condition of linear velocity v=77 mm/s in Test Example compared to Conventional Example.

According to FIGS. 17A and 17B, it was confirmed that, when the linear velocity v was 230 mm/s or 77 mm/s, an amplitude of the waveform of the sensor output Vt in Test Example was narrower than that in Conventional Example.

Further, when the linear velocity v is high (for example, v=230 mm/s), the average sensor output Vt_ave increased or became higher than the linear velocity v at 77 mm/s. By contrast, when the linear velocity v is low (for example, v=77 mm/s), the average sensor output Vt_ave decreased or became lower than the high linear velocity v at 230 mm/s. Accordingly, it was found that the value of the linear velocity shift volume ΔVt in Test Example becomes smaller than that in Conventional Example.

FIGS. 18A and 18B are graphs showing test results of Comparative Example in Test 2. That is, FIG. 18A is a graph indicating a waveform of the sensor output Vt when the linear velocity v is 230 mm/s in Comparative Example, and FIG. 18B is a graph indicating a waveform of the sensor output Vt when the linear velocity v is 77 mm/s in Comparative Example.

As shown in FIG. 18A, when the linear velocity v is 230 mm/s, the maximum sensor output Vt_max_1 obtained when the developer density is highest was equal to the value in Conventional Example. By contrast, the minimum sensor output Vt_min_1 obtained when the developer density is lowest was decreased or became smaller than the value in Conventional Example, as indicated by arrow D in FIG. 18A. This result was obtained by attaching the detection surface cleaning member C70 to have an angle opposite to the screw blade part 62*b* with respect to the axial direction of the rotary shaft member 62*a*. That is, the detection surface cleaning member C70 was disposed at a given angle (θC1) to the axial direction of the rotary shaft member 62*a* of the second conveyance screw C62. Therefore, the developer may be conveyed by the detection surface cleaning member C70 along the axial direction of the second conveyance screw C62 in an opposite direction to the direction of developer conveyed by the screw blade part 62*b* along the axial direction of the second conveyance screw C62. With this structure, the developer conveyed by the screw blade part 62*b* was stopped and accumulated at a position facing the detection surface 80. When the accumulated developer is scraped away and agitated from the position, airspace was easily formed after the agitation, which degraded the minimum sensor value Vt_min_1. Since the maximum sensor output Vt_max_1 was same as that of Conventional Example and the minimum sensor output Vt_min_1 was decreased or became smaller than that of Conventional Example, the average sensor output Vt_ave may decrease under the condition of linear velocity v=230 mm/s in Comparative Example compared to Conventional Example.

As shown in FIG. 18B, when the linear velocity v is 77 mm/s, the maximum sensor output Vt_max_2 obtained when the developer density is highest was increased or became greater than the value in Conventional Example, as indicated by arrow E in FIG. 18B. By contrast, the minimum sensor output Vt_min_2 obtained when the developer density is lowest was equal to the value in Conventional Example. The maximum sensor output Vt_max_2 increased because, by pressing the developer accumulated on the detection surface 80, the developer density of the accumulated developer was increased. Since the maximum sensor output Vt_max_2 was increased or became higher than that of Conventional Example and the minimum sensor output Vt_min_2 was same as that of Conventional Example, the average sensor output Vt_ave may increase under the condition of linear velocity v=77 mm/s in Comparative Example compared to Conventional Example.

According to FIGS. 18A and 18B, it was confirmed that, when the linear velocity v was 230 mm/s or 77 mm/s, an amplitude of the waveform of the sensor output Vt in Comparative Example was wider or greater than that in Conventional Example.

Further, when the linear velocity v is high (for example, v=230 mm/s), the average sensor output Vt_ave decreased or became lower than the linear velocity v at 77 mm/s. By contrast, when the linear velocity v is low (for example, v=77 mm/s), the average sensor output Vt_ave increased or became higher than the high linear velocity v at 230 mm/s. Accordingly, it was found that the value of the linear velocity shift volume ΔVt in Comparative Example becomes more increased than that in Conventional Example.

[Test 3]

Next, a description is given of results of Test 3 in which changes of the sensor detection characteristics are compared when the test environment was changed. In Test 3, two of the three screws used in Test 1 were used, which were the second conveyance screw A62 in Conventional Example and the second conveyance screw B62 in Test Example.

Following procedures are test conditions applied to the developing unit.

1. Screws:

Condition A: Second conveyance screw A62 in Conventional Example; and

Condition B: Second conveyance screw B62 in Test Example.

2. Unit Testing Machine:

As a unit testing machine prepared as a developing unit used in Test 3 has a same structure as the developing unit 5 in this exemplary embodiment. Conditions A and B have similar conditions to each other in employing identical units and elements, except that a toner density in the developer is fixed to 7 wt % and that a second conveyance screw is one of the second conveyance screw A62 according to Conventional Example and the second conveyance screw B62 according to Test Example.

3. Test Environment:

Environment 1: Temperature: 23 degrees Celsius; Humidity: 38% (Laboratory environment in winter); and Environment 2: Temperature: 27 degrees Celsius; Humidity: 80% (High temperature and high humidity).

4. Adjustment Value of Control Voltage of Toner Density Sensor:

In Conditions A and B, the control voltage Vcnt is adjusted to satisfy an equation: sensor output Vt (an average value of two cycles of the second conveyance screw)=2.5V, under the following calibrated conditions: Test Environment: Environment 1, Toner Density in Developer: 7 wt %, and Linear Velocity v: 230 mm/s.

When Test Environment is changed from Environment 1 to Environment 2, the control voltage Vcnt is not adjusted.

Table 1 shows results of Test 3.

TABLE 1

| | | Condition A (Fin Conventional Example) | | | Condition B (Fin in Test Example) | | |
|---|---|---|---|---|---|---|---|
| | | Env. 1 (23° C., 38%) | Env. 2 (27° C., 80%) | Ratio of Change | Env. 1 (23° C., 38%) | Env. 2 (27° C., 80%) | Ratio of Change |
| Linear Velocity 230 mm/s | Vt_max − Vt_min | 0.866 | 1.332 | 154% | 0.513 | 0.594 | 116% |
| Linear Velocity 77 mm/s | Vt_max − Vt_min | 0.683 | 0.673 | 99% | 0.501 | 0.522 | 104% |
| ΔVt = Vt_ave (v = 77 mm/s) − Vt_ave (v = 230 mm/s) | | 1.104 | 1.378 | 125% | 0.890 | 0.931 | 105% |

As shown in Table 1, it is clear that the ratios of change due to environmental changes in the characteristics of "Vt_max-Vt_min" when the linear velocity v is 230 mm/s and "ΔVt" are more reduced under Condition B than under Condition A. By contrast, the ratios of change due to environmental changes in the characteristics of "Vt_max-Vt_min" when the linear velocity v is 77 mm/s are substantially equal under Conditions A and B.

As the linear velocity is higher, environmental changes are more affected. However, it was confirmed according to the results of Test 3 that Test Example under Condition B can reduce the adverse affect more than Conventional Example under Condition A.

According to Tests 1 and 2, it was confirmed that Test Example can effectively reduce detection errors due to changes of linear velocity, compared to Conventional Example. Further, according to Test 3, it was confirmed that Test Example can effectively reduce detection errors due to changes of environment. Thus, compared to Conventional Example, Test Example can reduce the detection errors caused by conditions such as changes of linear velocity, environment, etc. The change of linear velocity is caused due to an agitation force (moment or torque) of an elastic sheet, and the change of environment is caused due to bulk developer density and developer flowability. It is contemplated that, when the screw having the agitation structure according to Test Example is employed, the detection errors due to such conditions can be reduced, regardless of conditions such as change of linear velocity and change of environment confirmed in the above-described tests. For example, deterioration of the surface of a developer particle due to its long use is caused by a condition affected by bulk concentration of developer and/or developer flowability, which is similar to the change of environment. Therefore, it is also contemplated that use of a screw having the agitation structure used in Test Example can reduce detection errors caused by the deterioration of the surface of a developer particle due to its long use.

According to Tests 1 to 3, it was confirmed that a developing unit having a screw used in Test Example can prevent accumulation of developer on the detection surface 80 and reduce the difference in developer densities generated before and after agitation of the elastic sheet 71. Further, it was confirmed that the above-described effects can be achieved when using a configuration in which the protruding part 67*a*Y is provided to constantly maintain the developer density in the vicinity of the detection surface 80.

Further, in Tests 1 to 3, Test Example used a similar configuration of a developing unit as Example 1, where the elastic sheet 71Y is attached to the fin 72Y mounted on the rotary shaft member 62*a*Y, separately from the screw blade part 62*b*Y. However, a same effect can be expected and achieved when a configuration same as Example 2, where the elastic sheet 71Y is attached to the screw blade part 62*b*Y.

Example 4

Figure 19:
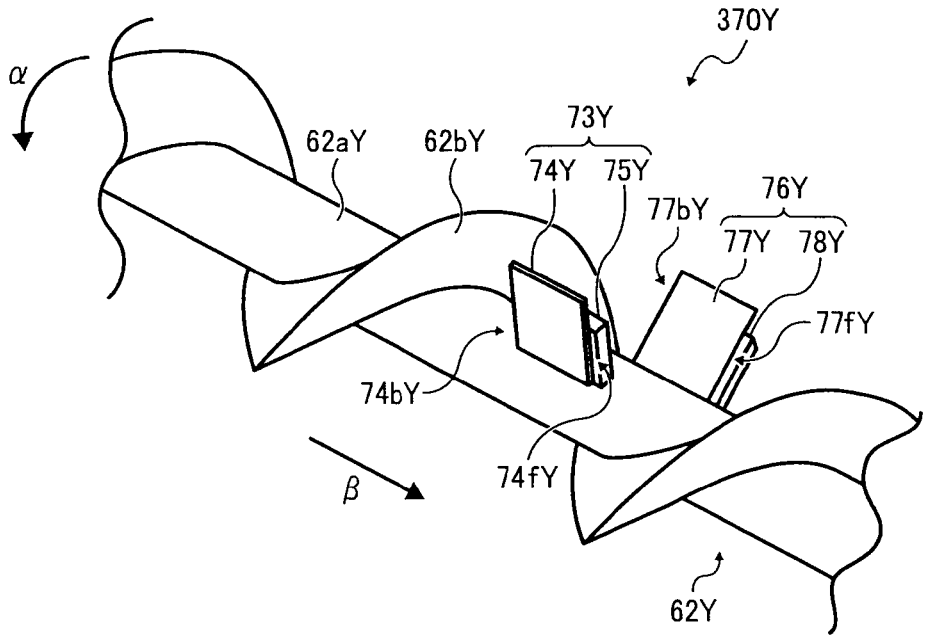
FIG. 19 is an enlarged view illustrating an area in the vicinity of upstream and downstream side cleaning members of a second conveyance screw according to Example 4 of the present invention.
Figure 20:
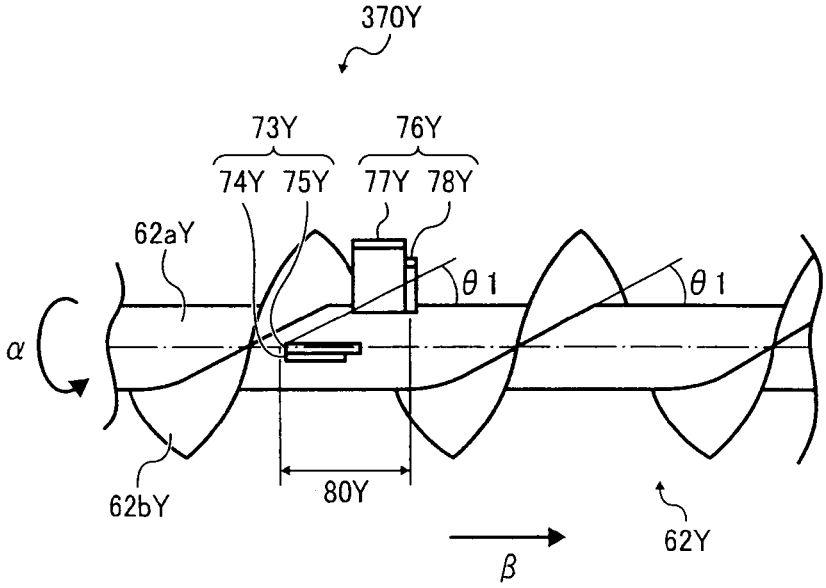
FIG. 20 is a drawing illustrating the second conveyance screw of FIG. 19, viewed from top of the downstream side cleaning member.

Next, referring to FIGS. 19 and 20, a description is given of the developing unit 5Y incorporating a detection surface cleaning member 370Y therein according to a fourth example of the present invention. Hereinafter, the fourth example is referred to as "Example 4."

FIG. 19 illustrates an enlarged view of an area in the vicinity of the detection surface cleaning member 370Y fixedly attached to the second conveyance screw 62Y of the developing unit 5Y according to Example 4, and FIG. 20 illustrates the second conveyance screw 62Y of FIG. 19, viewed in a vertical direction from top of a downstream side cleaning member 73Y. The configuration of the second conveyance screw 62Y of FIG. 19 according to Example 4 is similar to the configuration of the second conveyance screw 62Y of FIG. 4 according to Example 1, except that the detection surface cleaning member 70Y of Example 1 is replaced to the detection surface cleaning member 370Y that has two cleaning members, which are the downstream side cleaning member 73Y and an upstream side cleaning member 76Y. Elements or components of the developing unit 5Y according to Example 4 may be denoted by the same reference numerals as those of the developing unit 5Y according to Example 1 and the descriptions thereof are omitted or summarized.

The upstream side cleaning member 76Y is disposed at an upstream side in a direction of rotation (as indicated by arrow α in FIG. 19) of the second conveyance screw 62 according to Example 4. The downstream side cleaning member 73Y is disposed at a downstream side in the direction α of rotation of the second conveyance screw 62 according to Example 4.

As shown in FIG. 19, the downstream side cleaning member 73Y, which serves as a detection surface agitating member of the second conveyance screw 62 according to Example 4, has the same structure as the detection surface cleaning member 70Y of Example 1. That is, the downstream side cleaning member 73Y includes a downstream fin 75Y that serves as a planar member fixedly attached to the rotary shaft member 62*a*Y of the second conveyance screw 62Y and a downstream elastic sheet 74Y attached to the downstream fin 75Y. The upstream side cleaning member 76Y has an identical structure to the downstream side cleaning member 73Y, that is, includes an upstream fin 78Y that serves as a planar member fixedly attached to the rotary shaft member 62*a*Y of the second conveyance screw 62Y and an upstream elastic sheet 77Y attached to the upstream fin 78Y.

When the second conveyance screw 62Y rotates in a direction indicated by arrow α shown in FIG. 19, the downstream elastic sheet 74Y and the upstream elastic sheet 77Y scrape away and agitate the developer accumulated on the detection surface 80Y.

Same as Example 1, the toner density sensor 56Y is attached to an outer wall of the casing 55Y, where an inner wall thereof is determined as the detection surface 80 as a detection area of the toner density sensor 56Y. Further, the downstream elastic sheet 74Y and the upstream elastic sheet 77Y that scrape away and agitate the developer on the detection surface 80Y may be formed by multiple elastic sheets attached to each other.

In the developing unit 5 according to Example 4, the downstream elastic sheet 74Y and the upstream elastic sheet 77Y are disposed at different positions along the axial direction of the rotary shaft member 62*a*Y such that the respective root sides or fixed sides of the downstream elastic sheet 74Y and the upstream elastic sheet 77Y are arranged in the axial direction of the rotary shaft member 62*a*Y. Specifically, each width of the downstream elastic sheet 74Y and the upstream elastic sheet 77Y along the axial direction of the rotary shaft member 62*a*Y is half the width in the axial direction of the elastic sheet 71 of the detection surface cleaning member A70 in FIG. 10. An upstream end side of the upstream elastic sheet 77Y in the direction of conveyance of developer indicated by arrow β in FIG. 19 is referred to as a trailing side 77*b*Y and a downstream end side of the downstream elastic sheet 74Y in the direction β in FIG. 19 is referred to as a leading side 74*f*Y. The upstream side cleaning member 76Y and the downstream side cleaning member 73Y are disposed on the second conveyance screw 62Y of Example 4 such that the trailing side 77*b*Y and the leading side 74*f*Y cross an identical point along the direction of conveyance of developer or that the leading side 74*f*Y crosses a point downstream from a point where the trailing side 77*b*Y crosses along the direction of conveyance of developer. By disposing the downstream elastic sheet 74Y and the upstream elastic sheet 77Y as described above, developer on different areas of the detection surface 80Y in the axial direction can be scraped away and agitated by the downstream elastic sheet 74Y and the upstream elastic sheet 77Y. In the direction β of conveyance of developer in FIG. 19 according to Example 4, the upstream elastic sheet 77Y slidably move on a half area at a downstream side on the detection surface 80Y in the direction β and the downstream elastic sheet 74Y slidably move on the other half area at an upstream side on the detection surface 80Y in the direction β. By so doing, the developer on the detection surface 80Y can be removed therefrom and agitated.

Further, as shown in FIG. 19, the upstream elastic sheet 77Y and the downstream elastic sheet 74Y are located on positions different from each other in the direction of rotation of the second conveyance screw, or the direction α.

As described above, by scraping away the developer accumulated on the detection surface 80Y at different timings by elastic sheets disposed adjacent to each other, the entire detection surface 80Y may be scraped away and agitated not at one time but in steps.

In other words, fins and elastic sheets are disposed at multiple locations in Example 4 to scrape away and agitate developer on the detection surface 80Y in steps. Specifically, two elastic sheets, each having a half width of the elastic sheet B70 in the axial direction of the rotary shaft member 62*a*, are disposed in steps as shown in FIG. 19.

Compared to the structure where the single elastic sheet 71Y scrapes away the developer on the detection surface 80Y at once according to Conventional Example, after the upstream elastic sheet 77Y and the downstream elastic sheet 74Y have sequentially passed the detection surface 80Y, a void or airspace is not easily made on the detection surface 80Y in the above-described structure according to Example 4, thereby increasing the minimum value of the developer density on the detection surface 80Y.

Accordingly, same as Example 1, the second conveyance screw 62Y according to Example 4 incorporating the upstream side cleaning member 76Y and the downstream side cleaning member 73Y of the detection surface cleaning member 370Y can prevent the difference in developer densities before and after the leading edge of an elastic sheet passes the detection surface 80Y. Further, same as Example 1, this prevention can reduce variation of the difference in developer densities due to conditions such as linear velocity mode, environment, developer flowability, etc.

Further, a downstream end side of the upstream elastic sheet 77Y in the direction of conveyance of developer indicated by arrow β in FIG. 19 is referred to as a leading side 77*f*Y and an upstream end side of the downstream elastic sheet 74Y in the direction β in FIG. 19 is referred to as a leading side 74*b*Y. In the developing unit 5Y according to Example 4, the upstream side cleaning member 76Y and the downstream side cleaning member 73Y are disposed on the second conveyance screw 62Y such that the trailing side 74*b*Y crosses a point upstream from a point where an upstream side of the detection surface 80Y crosses along the direction of conveyance of developer and that the leading side 77*f*Y crosses a point downstream from a point where a downstream side of the direction target surface 80Y crosses along the direction of conveyance of developer. By disposing the downstream elastic sheet 74Y and the upstream elastic sheet 77Y as described above, the detection surface 80Y is included within an area formed by an area in which the downstream elastic sheet 74Y scrapes away and agitates the developer and an area in which the upstream elastic sheet 77Y scrapes away and agitates the developer. That is, an area of agitation by the downstream elastic sheet 74Y and the upstream elastic sheet 77Y is set to have a width greater than at least the width of the detection surface 80Y of the toner density sensor 56Y. Accordingly, the developer on the detection surface 80Y can be surely scraped away and agitated and the accumulation of developer thereon can be prevented.

Further, in Example 4, the upstream elastic sheet 77Y disposed downstream from the downstream elastic sheet 74Y in the axial direction of the second conveyance screw 62Y is disposed upstream from the downstream elastic sheet 74Y in the direction α. By disposing the upstream elastic sheet 77Y and the downstream elastic sheet 74Y as described above, after the downstream elastic sheet 74Y has scraped away and agitated the developer on the upstream area of the detection surface 80Y in the direction β, the upstream elastic sheet 77Y scrapes away and agitates the developer on the downstream area thereof in the direction β. That is, the upstream elastic sheet 77Y and the downstream elastic sheet 74Y are separately and discontinuously but adjacently arranged such that the angle of arrangement of the upstream elastic sheet 77Y and the downstream elastic sheet 74Y is substantially same as the screw blade part 62*b*Y with respect to the rotary shaft member 62*a*Y. Specifically as shown in FIG. 20, the downstream side cleaning member 73Y and the upstream side cleaning member 76Y are arranged at an angle θ1 to the rotary shaft member 62*a*Y, which is same as the screw blade part 62*b*Y.

Here, assume that there are two configurations, which are Configuration A and Configuration B. Configuration A is arranged same as the arrangement of the downstream side cleaning member 73Y and the upstream side cleaning member 76Y in FIGS. 19 and 20. That is, in Configuration A, two detection surface cleaning members are separately and discontinuously but adjacently arranged at a substantially same angle to the axial direction of the rotary shaft member 62*a*Y as the screw blade part 62*b*Y.

By contrast, in Configuration B, two detection surface cleaning members are disposed separately and discontinuously but adjacently with respect to the axial direction of the rotary shaft member 62*a*Y, and a downstream detection surface cleaning member disposed at a downstream side in the direction β is arranged at a downstream side in the direction α and an upstream detection surface cleaning member disposed at an upstream side in the direction β is arranged at an upstream side in the direction α. Specifically, a positional relation of the downstream side cleaning member 73 and the upstream side cleaning member 76 is opposite to the arrangement in FIGS. 19 and 20 and is oriented in a direction opposite to the screw blade part 62*b*Y. That is, the downstream side cleaning member 73 is located at the downstream side in the direction β and the upstream side cleaning member 76 is located at the upstream side in the direction β.

In Configuration A, the developer conveyed from the upstream side in the direction β is firstly scraped away and agitated by the downstream side cleaning member 73Y, and most of the developer is conveyed in the direction β by the conveyance force of the screw blade part 62*b*Y. After being scraped away and agitated by the downstream side cleaning member 73Y, most amount of developer is conveyed to the direction β according to the conveyance force of the screw blade part 62*b*Y even though some amount of developer is conveyed in a direction opposite the direction β, which is referred to as Condition A1.

Most of the developer under Condition A1 is then agitated by the upstream side cleaning member 76Y, and most amount of the developer is further conveyed to the direction β by the conveyance force of the screw blade part 62*b*Y. After being agitated by the upstream side cleaning member 76Y, most amount of developer is conveyed to the direction β according to the conveyance force of the screw blade part 62*b*Y even though some amount of developer is conveyed in the direction opposite the direction β, which is referred to as Condition A2.

As described with Conditions A1 and A2, the developer on the detection surface 80Y, which serves as a toner density sensor detection area, is scraped away and agitated by the detection surface cleaning member 370Y in the direction β. Therefore, the conveyance speed of developer does not reduce easily, which can prevent the change in developer density.

In Configuration B, the developer conveyed from the upstream side in the direction β is not always scraped away and agitated by the upstream side cleaning member 76Y before the downstream side cleaning member 73Y. Depending on the conveyance speed of developer in the direction β, the downstream side cleaning member 73Y may scrape away and agitate the developer before the upstream side cleaning member 76Y.

In this case, after being scraped away and agitated by the downstream side cleaning member 73Y, if some amount of developer is conveyed to the direction opposite the direction β, that amount of developer may be scraped away and agitated together with the developer conveyed from the upstream side of the direction β by the upstream side cleaning member 76Y before the conveyance force is exerted by the screw blade part Y. The conveyance force in the direction β exerted by the upstream side cleaning member 76Y is smaller than the conveyance force exerted by the screw blade part 62*a*Y. Therefore, when the developer conveyed in the direction β according to the agitation by the upstream side cleaning member 76Y and the developer conveyed in the direction opposite the direction β according to the conveyance force of the downstream side cleaning member 73Y merge, the developer can be easily accumulated and cause a reduction in conveyance speed at the developer merge position. Further, the developer merge position can be located on the detection surface 80Y. Thus, compared to a configuration in which the accumulation or conveyance speed of developer does not occur on the detection surface 80Y, the developer density can easily change before and after the upstream elastic sheet 77Y that serves as the conveyance elastic sheet passes the detection surface 80Y in Configuration B.

Therefore, when the developing unit 5Y according to Example 4 has the downstream side cleaning member 73Y and the upstream side cleaning member 76Y having their positional relation as Configuration A, the change in developer density may not easily occur and the variation of difference in developer densities can be prevented, compared to a developing unit that has the downstream side cleaning member 73Y and the upstream side cleaning member 76Y having their positional relation as Configuration B in which the direction or angle thereof is opposite to the screw blade part 62*b*Y.

Modified Example 2

In the developing unit 5 according to Example 4, the downstream elastic sheet 74Y and the upstream elastic sheet 77Y are disposed at different positions such that the respective root sides or fixed sides thereof are arranged in the axial direction of the rotary shaft member 62*a*Y. However, the developing unit 5 can have a configuration in which the fixed side of at least one of the downstream elastic sheet 74Y and the upstream elastic sheet 77Y is arranged at the substantially same angle as the screw blade part 62*b* with respect to an axial direction of the rotary shaft member 62*a*Y.

Figure 21:
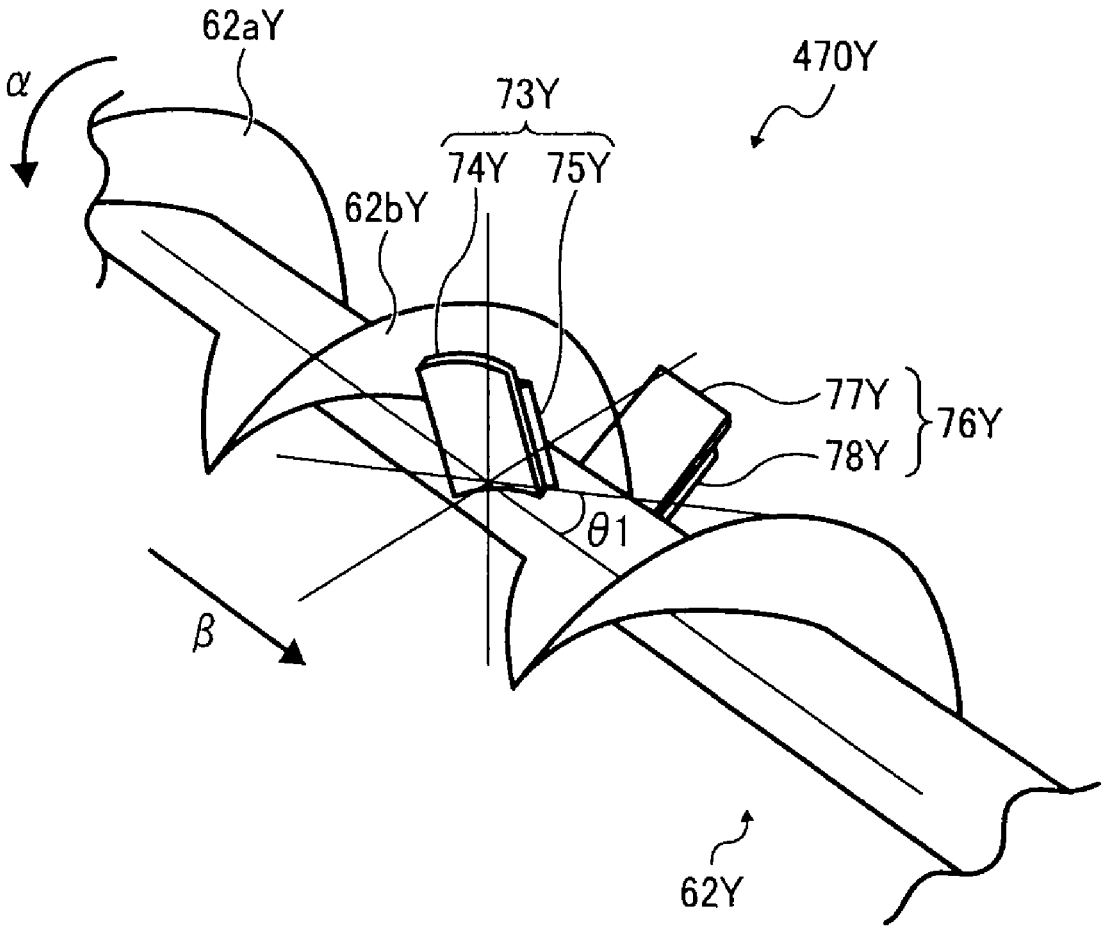
FIG. 21 is an enlarged view illustrating an area in the vicinity of a detection surface cleaning member of a second conveyance screw according to Modified Example 2 of the present invention.

Next, referring to FIG. 21, a description is given of the developing unit 5Y incorporating the second conveyance screw 62Y therein according to a second modified example of the present invention. Hereinafter, the second modified example is referred to as "Modified Example 2." Modified Example 2 provides a configuration in which one of two elastic sheets has the substantially same angle as the screw blade part 62*b*Y with respect to the rotary shaft member 62*a*Y of the second conveyance screw 62Y, according to Modified Example 2.

FIG. 21 illustrates an enlarged view of an area in the vicinity of the detection surface cleaning member 370'Y fixedly attached to the second conveyance screw 62Y of the developing unit 5Y according to Modified Example 2. The configuration of the second conveyance screw 62Y of FIG. 21 according to Modified Example 2 is similar to the configuration of the second conveyance screw 62Y of FIG. 19 according to Example 4, except that the downstream side cleaning member 73Y of Modified Example 2 is oriented in the substantially same direction as the screw blade part 62*b*Y with respect to the rotary shaft member 62*a*Y. Elements or components of the developing unit 5Y according to Modified Example 2 may be denoted by the same reference numerals as those of the developing unit 5Y according to Example 4 and the descriptions thereof are omitted or summarized.

Specifically, in Modified Example 2, by arranging the downstream side cleaning member 73Y to have a given angle to the rotary shaft member 62*a*Y, the downstream elastic sheet 74Y that serves as a detection surface agitating member has the substantially same angle as the screw blade part 62*b*Y with respect to the rotary shaft member 62*a*Y of the second conveyance screw 62Y. In FIG. 21, the downstream elastic sheet 74Y is oriented by an angle θ1 to the rotary shaft member 62*a*Y. Compared to the configuration in which the downstream elastic sheet 74Y is arranged in parallel to the rotary shaft member 62*a*Y, this arrangement can achieve the same effect as Example 1 to reduce difference in developer densities occurring before and after the downstream elastic sheet 74Y passes the area of the detection surface 80Y where the downstream elastic sheet 74Y scrapes away and agitates developer.

Same as in Example 4, the downstream elastic sheet 74Y and the upstream elastic sheet 77Y are arranged separately and discontinuously at different positions along the axial direction of the rotary shaft member 62*a*Y and in the direction of conveyance of developer or the direction a as shown in FIG. 21 in Modified Example 2. This arrangement in Modified Example 2 can prevent the difference in developer densities, which is same as the arrangement in Example 4. Further, by arranging the downstream elastic sheet 74Y with a given angle to the axial direction of the rotary shaft member 62*a*Y, the configuration according to Modified Example 2 can reduce difference in developer densities occurring before and after the downstream elastic sheet 74Y passes the area of the detection surface 80Y where the downstream elastic sheet 74Y scrapes away and agitates developer more effectively than the configuration according to Example 4. By so doing, the configuration according to Modified Example 2 can further reduce the difference in density densities more effectively than the configuration according to Example 4, and can prevent variations of difference in developer densities due to conditions such as linear velocity mode, environment, developer flowability, etc.

In Modified Example 2, one of the two elastic sheets have a given angle to the rotary shaft member 62*a*Y of the second conveyance screw 62Y such that the given angle of the one elastic sheet is substantially same as the angle of the screw blade part 62*b*Y with respect to the rotary shaft member 62*a*Y. However, both of the two elastic sheets can have the identical angle to the screw blade part 62*by* with respect to the rotary shaft member 62*a*Y.

Further, the configurations according to Example 4 and Modified Example 2 include two elastic sheets to be disposed at different positions both in the axial direction and in the direction of rotation of the rotary shaft member 62*a*Y. However, multiple elastic sheets disposed at different positions both in the axial direction and in the direction of rotation of the rotary shaft member 62*a*Y can be three or more. Further, even though multiple elastic sheets are incorporated in the detection surface cleaning member 370Y or 470Y as described in Example 4 and Modified Example 2, by applying the configuration that employs the protruding part 67*a*Y on the upper cover 67Y in the vicinity of the detection surface 80Y as explained with FIG. 6, the configuration can reduce the variations of the bulk density of the developer in the vicinity of the detection surface 80Y as described in Example 1.

As previously described, the four process cartridges 6Y, 6C, 6M, and 6K and the respective image forming components incorporated therein have similar structures and functions to each other, except that respective toners are of different colors, which are yellow, cyan, magenta and black toners. Therefore, the image components having reference numeral without suffixes "Y", "C", "M", and "K" can be applied to the image components having the identical reference numeral with the suffixes "Y", "C", "M", and "K".

In the above-described examples and modified examples according to the present invention, the process cartridge 6Y and the image forming components including the second conveyance screw 62Y are focused on and explained. However, as described above, the same effect can be achieved by the process cartridges 6C, 6M, and 6K and the image forming components included in the process cartridges 6C, 6M, and 6K to which the present invention is applied.

Further, the above-described examples and modified examples according to the present invention can be also applied to a developing unit 6 when the developing unit 6 is incorporated in an image forming apparatus or printer 100 having a configuration in which only the developing unit 6 can be detachably attached thereto.

As described above, the developing unit 5 having the configuration according to either Example 1 or Example 2 includes the developing sleeve 51, the casing 55, the second conveyance screw 62, the toner density sensor 56, and the detection surface cleaning member 70 or 170. The developing sleeve 51 serves as a developer bearing member for bearing developer including toner particles and carrier particles. The casing 55 forms the first developer container 53 and the second developer container 54 containing the developer to supply to the developing sleeve 51. The second conveyance screw 62 has the rotary shaft member 62*a* with the spiral screw blade part 62*b* fixedly mounted thereon and which rotates around the rotary shaft member 62*a* to agitate the developer in the casing and convey the developer in an axial direction of the rotary shaft member 62*a*. The toner density sensor 56 serves a toner density detecting unit to detect a density of the toner particles on the detection surface 80 formed by a part of an inner wall of the casing 55 disposed parallel to the rotary shaft member 62*a* of the second conveyance screw 62. The detection surface cleaning member 70 or 170 is fixedly mounted on the rotary shaft member 62*a* of the second conveyance screw 62 at a position facing the detection surface to scrape away the developer accumulated on the detection surface 80 as the screw rotates. The detection surface cleaning member 70 or 170 includes the elastic sheet 71 or 171, which is elastically deformable to scrape away the developer accumulated on the detection surface 80 and is disposed at a substantially same angle to the axial direction of the rotary shaft member 62*a* of the second conveyance screw 62 as the spiral screw blade part 62*b*.

In the above-described developing unit 5, since the elastic sheet 71 or 171 is disposed at a substantially same angle to the rotary shaft member 62*a* as the screw blade part 62*b*, the pressing force or the conveyance force that the elastic sheet 71 or 171 applies to convey the developer can be provided not only in the direction of rotation of the second conveyance screw 62 but also in the direction of conveyance of the developer. As the direction of conveyance of the developer is same as the direction the elastic sheet 71 or 171 applies the pressing force to convey the developer, the developer accommodated downstream from the elastic sheet 71 or 171 is conveyed further downstream due to the conveyance force of the second conveyance screw 62, thereby accepting the developer pressed and conveyed by the elastic sheet 71 or 171. Therefore, the developer existing between the elastic sheet 71 or 171 and the detection surface 80 is pressed toward the detection surface 80 as it shifts in the direction of conveyance of the developer. Accordingly, the volume or amount of developer pressed on the detection surface 80 at once by the elastic sheet 71 or 171 may be reduced, thereby lowering the maximum value of developer density on the detection surface 80, compared to related-art developing units in which developer is pressed onto the detection surface 80 at once. Further, the position where the elastic sheet 71 or 171 performs agitation on the detection surface 80 may shift to a further downstream side in the direction of conveyance of the developer. In the above-described configuration, the elastic sheet 71 or 171 sequentially scrapes away the developer on the detection surface 80. At this time, the developer may be sequentially conveyed to the void or space generated as the elastic sheet 71 or 171 scrapes away the developer on the detection surface 80 from the upstream side from the elastic sheet 71 or 171 in the direction of conveyance of the developer. Therefore, the developing unit 5 can reduce the void or space on or in the vicinity of the detection surface 80 after the passage of the elastic sheet 71 or 171, compared to related-art developing units having the configuration in which developer is pressed onto the detection surface 80 at once. This can increase the minimum value of the developer density on the detection surface 80.

Therefore, compared to related-art developing units having the configuration in which the detection surface cleaning member is disposed parallel to the rotary shaft member of the conveyance screw, the developing unit 5 can decrease the maximum value of the developer density on the detection surface 80 and increase the minimum value thereof. Accordingly, the toner density sensor 56Y can prevent the detection errors caused by the accumulation of developer on the detection surface 80 and reduce the difference of developer densities on the detection surface 80 during agitation.

Further, the developing unit 5 having the configuration according to Example 1 includes the fin 72 that is fixedly mounted on the rotary shaft member 62*a* of the second conveyance screw 62 therein at the position facing the detection surface 80. The fin 72 rotates without contacting the inner wall of the casing 55 as the second conveyance screw 62 rotates, and has a rigidity sufficient substantially to prevent the fin 72 from deforming during agitation of the developer.

The fin 72 is arranged at a substantially same angle to the axial direction of the rotary shaft member 62*a* of the second conveyance screw 62 as the screw blade part 62*b* and has the elastic sheet 71 fixed thereon.

The fin 72 having a planar shape is attached to the rotary shaft member 62*a* of the second conveyance screw 62 in the developing unit 5 according to Example 1 of the present invention, while the elastic sheet 71 is attached to the screw blade part 62*b* having a curved shape of the second conveyance screw 62 in the developing unit 5 according to Example 2 of the present invention. Accordingly, compared to the configuration of the developing unit 5 according to Example 2, the second conveyance screw 62 provided with the elastic sheet 71 of the developing unit 5 according to Example 1 can be manufactured easier.

Further, in the developing unit 5 having the configuration according to Example 2, the elastic sheet 171 is fixed to the screw blade part 62*b* of the second conveyance screw 62 that faces the detection surface 80. With the developing unit 5 according to Example 2, the second conveyance screws 62 that are manufactured by using a mold of a screw without a fin can achieve the same effect by attaching the elastic sheet 171 to a position facing the detection surface 80.

Further, according to Examples 1 through 3, the developing unit 5 includes the protruding part 67*a* of the second developer container 54 that serves as the developer conveyance path surrounded by the inner wall of the casing 55 and along which the second conveyance screw 62 applies the conveyance force to convey the developer.

With the developing unit 5 according to Examples 1 to 3, the cross-sectional area or the distance from the lower surface of the upper cover 67 of the developing unit 5 to the inner surface of the bottom portion of the second developer container 54 on or in the vicinity of the detection surface 80 is smaller than cross-sectional areas formed upstream from the detection surface 80 in the direction of conveyance of developer. With the protruding part 67*a* as described above, the cross-sectional area at the protruding part 67*a* becomes narrower than the cross-sectional areas of the other cross-sectional areas of the second developer container 54, which can result in that developer may be more packed when passing the area at or in the vicinity of the protruding part 67*a* than when passing the other areas thereof and can cause less variation of the bulk density of developer. Since the detection surface 80 is located at a position facing the detection surface cleaning member 70, 170 or 270, the protruding part 67*a* disposed as described above can prevent fluctuation of the bulk density of the developer in the vicinity of the detection surface 80.

Further, the configuration according to Modified Example 1 can be applied as a configuration that can prevent the fluctuation of the bulk density of developer in the vicinity of detection target surface 80. Specifically, the configuration according to Modified Example 1 provides the pitch of adjacent portions of the spiral screw blade part 62*b* to be narrower at a position in the vicinity of the detection surface than a position upstream from the detection surface 80 in the direction of conveyance of developer by the second conveyance screw 62.

Further, the developing unit 5 is integrally mounted with the photoconductor 1 as the process cartridge 6 detachably attachable for use in the printer 100 so that consumables incorporated in the process cartridge 6 can be replaced at one time. By so doing, it is possible to provide the process cartridge 6 that can prevent the defective images caused by aggregated toner and detect the toner density in the accommodated developer accurately.

Further, by incorporating the developing unit 5 in the printer 100, it is possible to provide an image forming apparatus that can prevent the detection error cased by the accumulation of developer on the detection surface 80 of the toner density sensor 56 and can reduce the difference in developer densities on the detection surface 80 during agitation.

Further, the developing unit 5 according to Example 4 carries developer including toner particles and carrier particles, and includes the developing sleeve 51 that serves as the developer bearing member for development. Further, the developing unit 5 according to Example 4 includes the casing 55, the second conveyance screw 62, the toner density sensor 56, and the detection surface cleaning member 370 including the downstream side cleaning member 73 and the upstream side cleaning member 76. The casing 55 forms the first developer container 53 and the second developer container 54 containing the developer to supply to the developing sleeve 51. The second conveyance screw 62 has the rotary shaft member 62*a* with the spiral screw blade part 62*b* fixedly mounted thereon and which rotates around the rotary shaft member 62*a* to agitate the developer in the casing and convey the developer in an axial direction of the rotary shaft member 62*a*. The toner density sensor 56 serves a toner density detecting unit to detect a density of the toner particles on the detection surface 80 formed by a part of an inner wall of the casing 55 disposed parallel to the rotary shaft member 62*a* of the second conveyance screw 62.

The downstream side cleaning member 73 and the upstream side cleaning member 76 of the detection surface cleaning member 370 are fixedly mounted on the rotary shaft member 62*a* of the second conveyance screw 62 at different positions facing the detection surface 80 to scrape away the developer accumulated on the detection surface 80 as the screw rotates. The downstream side cleaning member 73 includes the downstream fin 75 that serves as a planar member fixedly attached to the rotary shaft member 62*a* of the second conveyance screw 62 and the downstream elastic sheet 74 that is attached to the downstream fin 75 and is elastically deformable to scrape away and agitate the developer on the detection surface 80. The upstream side cleaning member 76 includes the upstream fin 78 that serves as a planar member fixedly attached to the rotary shaft member 62*a* of the second conveyance screw 62 and the upstream elastic sheet 77 that is attached to the upstream fin 78 and is elastically deformable to scrape away and agitate the developer on the detection surface 80. By disposing the downstream elastic sheet 74 and the upstream elastic sheet 77 as described above, developer on different areas of the detection surface 80 in the axial direction can be scraped away and agitated by the downstream elastic sheet 74 and the upstream elastic sheet 77. Further, the upstream elastic sheet 77 and the downstream elastic sheet 74 are located adjacently in the axial direction of the second conveyance screw 62 but on positions different from each other in the direction of rotation of the second conveyance screw 62. By scraping away the developer on the at different timings by elastic sheets disposed adjacent to each other, the entire detection surface 80 may be scraped away and agitated not at one time but in steps (in this case, in two steps). By so doing, compared to the configuration where the single elastic sheet 71 scrapes away the developer accumulated on the detection surface 80 at once according to related-art developing units, after the upstream elastic sheet 77 and the downstream elastic sheet 74 have sequentially passed the detection surface 80, the void or airspace is not easily made on the detection surface 80 in the above-described configuration according to Example 4, thereby increasing the minimum value of the developer density on the detection surface 80.

Therefore, same as the second conveyance screw 62 according to Example 1, the second conveyance screw 62 having the downstream side cleaning member 73 and the upstream side cleaning member 76 of the detection surface cleaning member 370 according to Example 4 can prevent the difference in developer densities before and after the leading edge of the elastic sheet passes the detection surface 80. Further, same as the developing unit 5 having the configuration according to Example 1, the developing unit 5 having the configuration according to Example 4 can reduce variation or fluctuation of the difference in developer densities due to conditions such as linear velocity mode, environment, developer flowability, etc.

Further, in the developing unit 5 according to Example 1, the upstream side cleaning member 76 and the downstream side cleaning member 73 are disposed on the second conveyance screw 62 such that the detection surface 80 is included in the area in which at least one of the upstream side cleaning member 76 and the downstream side cleaning member 73 scrapes the developer accumulated on the detection surface 80. That is, the detection surface 80 is provided within the area where both the downstream elastic sheet 74 and the upstream elastic sheet 77 scrape away and agitate the developer on the detection surface 80. By disposing the downstream elastic sheet 74 and the upstream elastic sheet 77 as described above, the detection surface 80 is included within the area formed by the area in which the downstream elastic sheet 74 scrapes away and agitates the developer on the detection surface 80 and the area in which the upstream elastic sheet 77 scrapes away and agitates the developer thereof. Accordingly, the developer accumulated on the detection surface 80 can be surely scraped away and agitated, and the accumulation of developer thereon can be prevented.

Further, of the multiple elastic sheets disposed on the rotary shaft member 62*a* in Example 4, the elastic sheet disposed further downstream in the direction of conveyance of the developer along the axis of the rotary shaft member 62*a* is arranged further upstream in the direction of rotation of the rotary shaft member 62*a*. That is, the trailing side 77*b* of the upstream elastic sheet 77 disposed downstream from the downstream elastic sheet 74 in the axial direction of the second conveyance screw 62 is disposed upstream from the downstream elastic sheet 74 in the direction $\alpha$ in FIG. 19. By disposing the upstream elastic sheet 77 and the downstream elastic sheet 74 as described above, after the downstream elastic sheet 74 has scraped away and agitated the developer on the upstream area of the detection surface 80 in the direction of conveyance of the developer, the upstream elastic sheet 77 scrapes away and agitates the developer on the downstream area thereof in the direction of conveyance of the developer. That is, the upstream elastic sheet 77 and the downstream elastic sheet 74 are separately and discontinuously but adjacently arranged such that the angle of arrangement of the upstream elastic sheet 77 and the downstream elastic sheet 74 is substantially same as the screw blade part 62*b* with respect to the rotary shaft member 62*a*. By disposing the detection surface cleaning member 370 as described above, compared to the developing unit 5 where the positional relation of the direction or angle of the downstream elastic sheet 74 and the upstream elastic sheet 77 to the rotary shaft member 62*a* is opposite to the screw blade part 62*b*, the change in developer densities caused before and after the passage of the downstream elastic sheet 74 can be prevented.

Further, of the two elastic sheets in the developing unit 5 according to Modified Example 2, the downstream elastic sheet 74 is arranged at the substantially same angle as the screw blade part 62*b* with respect to an axial direction of the rotary shaft member 62*a*Y. By arranging the elastic sheets as described above, compared to the developing unit 5 having the configuration in which the downstream elastic sheet 74 is disposed parallel to the rotary shaft member 62*a*, the configuration according to Modified Example 2 can reduce difference in developer densities occurring before and after the downstream elastic sheet 74 passes the area of the detection surface 80 where the downstream elastic sheet 74 scrapes away and agitates the developer accumulated on the detection surface 80 more effectively, which is same as Example 1.

The above-described exemplary embodiments are illustrative, and numerous additional modifications and variations are possible in light of the above teachings. For example, elements and/or features of different illustrative and exemplary embodiments herein may be combined with each other and/or substituted for each other within the scope of this disclosure. It is therefore to be understood that, the disclosure of this patent specification may be practiced otherwise than as specifically described herein.

Obviously, numerous modifications and variations of the present invention are possible in light of the above teachings. It is therefore to be understood that, the invention may be practiced otherwise than as specifically described herein.

What is claimed is:

1. A process cartridge for use in an image forming apparatus, the process cartridge comprising:

an image bearing member to bear an image on a surface thereof; and a developing unit to develop the image formed on the image bearing member and integrally incorporated together with the image bearing member in the process cartridge, wherein the developing unit comprises:

a developer bearing member used for image developing and to bear developer including toner particles and carrier particles;

a casing to form a developer container containing the developer to supply to the developer bearing member;

a conveyance screw having a shaft with a spiral screw blade fixedly mounted thereon and which rotates around the shaft to agitate the developer in the casing and convey the developer in an axial direction of the shaft;

a toner density sensor to detect a density of the toner particles on a detection surface formed by a part of an inner wall of the casing disposed parallel to the shaft of the conveyance screw; and a detection surface agitating member fixedly mounted on the shaft of the screw at a position facing the detection surface to scrape away the developer accumulated on the detection surface according to a rotation of the screw, the detection surface agitating member including an elastic sheet disposed at a substantially same angle to the axial direction of the shaft of the conveyance screw as the spiral screw blade and elastically deformable to scrape away the developer accumulated on the detection surface.

2. The process cartridge according to claim 1, further comprising a planar member fixedly mounted on the shaft of the screw in the developing unit at a position facing the detection surface and that rotates without contacting the inner wall of the casing as the screw rotates, and has a rigidity sufficient substantially to prevent the planar member from deforming during agitation of the developer, the planar member arranged at a substantially same angle to the axial direction of the shaft of the screw as the spiral screw blade and having the elastic sheet fixed thereon.

3. The process cartridge according to claim 1, wherein the elastic sheet is fixed to the screw blade facing the detection surface for the screw.

4. The process cartridge according to claim 1, further comprising a developer conveyance path surrounded by the inner wall of the casing and along which the screw applies a conveyance force to convey the developer, wherein the developer conveyance path has a cross-section narrower in the vicinity of the detection surface than a position upstream from the detection surface in a direction of conveyance of developer by the screw.

5. The process cartridge according to claim 1, wherein a pitch of adjacent portions of the spiral screw blade on the screw is narrower at a position in the vicinity of the detection surface than a position upstream from the position in the vicinity of the detection surface in the direction of conveyance of developer by the screw.

6. A process cartridge for use in an image forming apparatus, the process cartridge comprising:

an image bearing member to bear an image on a surface thereof; and a developing unit to develop the image formed on the image bearing member and integrally incorporated together with the image bearing member in the process cartridge, wherein the developing unit comprises:

a developer bearing member used for image developing and to bear developer including toner particles and carrier particles;

a casing to form a developer container containing the developer to supply to the developer bearing member;

a conveyance screw having a shaft with a spiral screw blade fixedly mounted thereon and which rotates around the shaft to agitate the developer in the casing and convey the developer in an axial direction of the shaft;

a toner density sensor to detect a density of the toner particles on a detection surface formed by a part of an inner wall of the casing disposed parallel to the shaft of the conveyance screw; and a detection surface agitating member fixedly mounted on the shaft of the screw at a position facing the detection surface to scrape away the developer accumulated on the detection surface according to a rotation of the screw, wherein the detection surface agitating member including multiple elastic sheets elastically deformable to scrape away the developer accumulated on different areas of the detection surface in an axial direction of the shaft, the multiple elastic sheets are disposed at different positions in the axial direction of the shaft and are arranged at different positions along a direction of rotation of the screw, and an angle formed by a relative position of the multiple elastic sheets with respect to the axial direction of the shaft is substantially the same as an angle formed by the screw blade.

7. The process cartridge according to claim 6, wherein the detection surface is included in an area in which at least one of the multiple elastic sheets scrapes away the developer.

8. The process cartridge according to claim 6, wherein, of the multiple elastic sheets, an elastic sheet disposed further downstream in a direction of conveyance of the developer along the axis of the shaft is arranged further upstream in the direction of rotation of the screw.

9. The process cartridge according to claim 6, wherein at least one of the multiple elastic sheets is arranged at a substantially same angle to the axial direction of the shaft of the screw as the spiral screw blades to the shaft.

10. The process cartridge according to claim 6, further comprising a planar member fixedly mounted on the shaft of the screw in the developing unit at a position facing the detection surface and that rotates without contacting the inner wall during a rotation of the screw, and has a rigidity sufficient substantially to prevent the planar member from deforming during agitation of the developer, the planar member arranged at a substantially same angle to the axial direction of the shaft of the conveyance screw the spiral screw blades and having the elastic sheet fixed thereon.

11. The process cartridge according to claim 6, further comprising a developer conveyance path surrounded by the inner wall of the casing and along which the screw applies a conveyance force to convey the developer, wherein the developer conveyance path has a cross-section narrower in the vicinity of the detection surface than a position upstream from the detection surface in a direction of conveyance of developer by the screw.

12. The process cartridge according to claim 6, wherein a pitch of adjacent portions of the spiral screw blade on the screw is narrower in the vicinity of the detection surface than a position upstream from the detection surface in the direction of conveyance of developer by the screw.

13. A process cartridge for use in an image forming apparatus, the process cartridge comprising:

an image bearing member to bear an image on a surface thereof; and a developing unit to develop the image formed on the image bearing member and integrally incorporated together with the image bearing member in the process cartridge, wherein the developing unit comprises:

a developer bearing member used for image developing and to bear developer including toner particles and carrier particles;

a casing to form a developer container containing the developer to supply to the developer bearing member;

a conveyance screw having a shaft with a spiral screw blade fixedly mounted thereon that rotates around the shaft to agitate the developer in the casing and convey the developer in an axial direction of the shaft;

a toner density sensor to detect a density of the toner particles on a detection surface formed by a part of an inner wall of the casing disposed parallel to the shaft of the conveyance screw; and a detection surface agitating member fixedly mounted on the shaft of the screw at a position facing the detection surface to scrape away the developer accumulated on the detection surface as the screw rotates, wherein the detection surface agitating member includes a planar member fixedly mounted on the shaft of the screw in the developing unit at a position facing the detection surface and that rotates without contacting the inner wall of the casing as the screw rotates, and has a rigidity to substantially prevent the planar member from deforming during agitation of the developer, wherein multiple elastic sheets are secured to the planer member, and a first of the elastic sheets extends further from the planar member than a second of the elastic sheets in a direction away from the shaft of the screw.

* * * * *